US008330695B2

(12) United States Patent
Irie et al.

(10) Patent No.: US 8,330,695 B2
(45) Date of Patent: Dec. 11, 2012

(54) LIQUID CRYSTAL DISPLAY DEVICE, METHOD FOR DRIVING THE SAME, AND TELEVISION RECEIVER

(75) Inventors: Kentaroh Irie, Osaka (JP); Fumikazu Shimoshikiryoh, Osaka (JP); Masae Kawabata, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/998,144

(22) PCT Filed: Jul. 24, 2009

(86) PCT No.: PCT/JP2009/063277

§ 371 (c)(1),
(2), (4) Date: Mar. 22, 2011

(87) PCT Pub. No.: WO2010/038535

PCT Pub. Date: Apr. 8, 2010

(65) Prior Publication Data

US 2011/0170014 A1 Jul. 14, 2011

(30) Foreign Application Priority Data

Oct. 3, 2008 (JP) ..... 2008-258724

(51) Int. Cl.
*G09G 3/36* (2006.01)

(52) U.S. Cl. ..... 345/96; 345/209; 348/729

(58) Field of Classification Search ..... 345/87, 345/96, 99, 100, 204, 214, 209; 348/729, 348/731

See application file for complete search history.

(56) References Cited

U.S. PATENT DOCUMENTS

| | | | | |
|---|---|---|---|---|
| 8,014,488 | B2 * | 9/2011 | Jang | 377/64 |
| 2006/0033696 | A1 | 2/2006 | Nakamura et al. | |
| 2006/0041805 | A1 | 2/2006 | Song | |

FOREIGN PATENT DOCUMENTS

| | | | |
|---|---|---|---|
| JP | 8087000 | A | 4/1996 |
| JP | 2001051252 | A | 2/2001 |
| JP | 2006053428 | A | 2/2006 |
| JP | 2006284823 | A | 10/2006 |

OTHER PUBLICATIONS

International Search Report.
Extended European Search Report for corresponding European patent application No. 09817572.2 dated Mar. 22, 2012.

* cited by examiner

*Primary Examiner* — Abbas Abdulselam
(74) *Attorney, Agent, or Firm* — Harness, Dickey & Pierce, P.L.C.

(57) ABSTRACT

A plurality of groups each of which includes a plurality of scanning signal lines are sequentially selected; a polarity of the data signal electric potentials in one (first group) of sequentially-selected groups is set to be different from that of the other (second group) of the two groups; two pieces of dummy scan periods are put between (i) a horizontal scan period corresponding to a last horizontal scan in the first group and (ii) a horizontal scan period corresponding to a first horizontal scan in the second group; dummy signal electric potentials are supplied to the data signal line in the dummy scan periods; and a time period from when a scanning pulse which corresponds to the last horizontal scan in the first group becomes nonactive to when the dummy scan period is started is set to be longer than a time period from when a scanning pulse corresponding to one of consecutive two horizontal scans becomes nonactive in the first group to when a horizontal scan period corresponding to the other of the consecutive two horizontal scans is started. This makes it possible to enhance display quality in a case where the data signal line is subjected to the block-reversal driving.

26 Claims, 18 Drawing Sheets

LIQUID CRYSTAL DISPLAY DEVICE, METHOD FOR DRIVING THE SAME, AND TELEVISION RECEIVER

TECHNICAL FIELD

The present invention relates to a driving (block-reversal driving) in which polarities of signal electric potentials supplied to a data signal line are reversed for every plurality of horizontal scan periods.

BACKGROUND ART

A liquid crystal display device has excellent properties such as high-definition, a thin shape, lightweight, and low power consumption. Owing to the properties, a market scale of the liquid crystal display device has been rapidly expanded in these years. According to the liquid crystal display device, a dot-reversal driving has been widely employed in which polarities of signal electric potentials supplied to a data signal line are reversed for each horizontal scan period. However, according to the dot-reversal driving, a polarity-reversal frequency of a data signal line becomes high and thereby (i) a pixel charging rate is decreased and (ii) power consumption is increased. In view of this, a block-reversal driving has been proposed in which polarities of signal electric potentials to be supplied to a data signal line are reversed for every plural horizontal scan periods (for example, see Patent Literature 1). According to the block-reversal driving, it is possible to (i) improve a pixel charging rate and (ii) suppress power consumption and a heating value.

Patent Literature 1 discloses a technique regarding a block-reversal driving in which a dummy scan period is added right after a polarity reversal (see FIG. 18). According to the configuration, a piece of data (n+2) which is the one right after a polarity reversal corresponds to a dummy scan period (third horizontal scan period in FIG. 18) for pre-charge and a horizontal scan period (fourth horizontal scan period in FIG. 18) for actual charge (writing). Accordingly, a charging ratio of a pixel corresponding to the piece of data (n+2) can be enhanced.

Citation List

Patent Literature 1

Japanese Patent Application Publication, Tokukai, No. 2001-51252 (Publication Date: Feb. 23, 2001)

SUMMARY OF INVENTION

Technical Problem

However, the inventors of the present invention found that the technique shown in FIG. 18 has problems as shown in FIGS. 19 and 20. Specifically, a rectangular gate pulse GP(n+1) for carrying out a horizontal scan is supplied to a scanning signal line G(n+1), while a potential waveform GV(n+1) of the scanning signal line G(n+1) does not become rectangle due to parasitic resistor and parasitic capacitor but has a dull section (shaded part in FIG. 19). Accordingly, a TFT of a pixel P(n+1) corresponding to the scanning signal line G(n+1) keeps turning on for a while (during a dull period) after the gate pulse GP(n+1) becomes nonactive.

The dummy scan period is started (a signal electric potential corresponding to the piece of data (n+2) is supplied to the data signal line) in sync with the gate pulse GP(n+1) becoming nonactive. Accordingly, the signal electric potential corresponding to the piece of data (n+2) is written into the pixel P(n+1) in the dull period. Moreover, the signal electric potential corresponding to the piece of data (n+1) has a positive polarity, whereas the signal electric potential corresponding to the piece of data (n+2) has a negative polarity. Accordingly, electricity is discharged from the pixel P(n+1) during the dull period, and thereby the pixel P(n+1) becomes dark in the normally black liquid crystal display device (see FIG. 20). According to the technique shown in FIG. 18, blackish lateral stripes could be seen in the conventional display as shown in FIG. 20.

The present invention is accomplished in view of the problem, and its object is to improve display quality of a liquid crystal display device in which a block-reversal driving is carried out.

Solution to Problem

According to a liquid crystal display device of the present invention, a plurality of groups each of which includes a plurality of scanning signal lines are sequentially selected; data signal electric potentials having identical polarities are sequentially supplied to a data signal line for each horizontal scan period, in response to a plurality of scanning signal lines, which belong to a selected one of the plurality of groups, being sequentially subjected to horizontal scans; a scanning pulse for each of the horizontal scans is supplied to each of the plurality of scanning signal lines; a polarity of the data signal electric potentials for a first group is different from that of a second group, the first and second groups being sequentially selected, the second group being selected after the first group is selected; n-piece (n is an integer of 1 or more) of dummy scan period(s) is(are) put between (i) a horizontal scan period corresponding to a last horizontal scan in the first group and (ii) a horizontal scan period corresponding to a first horizontal scan in the second group; a dummy signal electric potential is supplied to the data signal line in a dummy scan period included in the n-piece of dummy scan period(s); and a time period from a time point when a scanning pulse which corresponds to the last horizontal scan in the first group becomes nonactive to a time point when the dummy scan period is started is set to be longer than a time period from a time point when a scanning pulse corresponding to one of consecutive two horizontal scans becomes nonactive in the first group to a time point when a horizontal scan period corresponding to the other of the consecutive two horizontal scans is started.

According to the configuration, the horizontal scan period corresponding to the last horizontal scan in the first group is set to be longer than the other horizontal scan period. This makes it possible to prevent a phenomenon in which electric charge written into a pixel during the last horizontal scan period is discharged when the dummy scan period following the last horizontal scan period is started. Accordingly, it is possible to reduce the blackish lateral stripes (see FIG. 20) which are the problem seen in the conventional technique.

According to the liquid crystal display device of the present invention, it is possible that the dummy signal electric potential has a polarity which is identical to a polarity of the data signal electric potentials in the second group.

According to the liquid crystal display device of the present invention, it is possible that the scanning pulse corresponding to the other of the consecutive two horizontal scans becomes active in sync with the scanning pulse corresponding to the one of the consecutive two horizontal scans becoming nonactive.

According to the liquid crystal display device of the present invention, it is possible that a horizontal scan period corresponding to an arbitrary horizontal scan is started after a scanning pulse corresponding to the arbitrary horizontal scan becomes active.

According to the liquid crystal display device of the present invention, it is possible that the horizontal scan period corresponding to the last horizontal scan in the first group is longer than a previous horizontal scan period which comes before the horizontal scan period corresponding to the last horizontal scan in the first group.

According to the liquid crystal display device of the present invention, it is possible that a scanning pulse corresponding to the first horizontal scan in the second group becomes active before the dummy scan period is started.

According to the liquid crystal display device of the present invention, it is possible that a scanning pulse corresponding to the first horizontal scan in the second group becomes active after the dummy scan period is started.

According to the liquid crystal display device of the present invention, it is possible that the horizontal scan period corresponding to the other of the consecutive two horizontal scans is started in sync with the scanning pulse corresponding to the one of the consecutive two horizontal scans becoming nonactive.

According to the liquid crystal display device of the present invention, it is possible that plural pieces of video data which correspond to respective horizontal scans on the plurality of scanning signal lines are arranged in an order corresponding to the horizontal scans; n-piece of dummy data is(are) put between (i) a piece of video data corresponding to the last horizontal scan in the first group and (ii) a piece of video data corresponding to the first horizontal scan in the second group; the data signal electric potentials correspond to the respective plural pieces of video data; and the dummy signal electric potential corresponds to a piece of dummy data included in the n-piece of dummy data.

According to the liquid crystal display device of the present invention, it is possible that the plural pieces of video data and the piece of dummy data are latched in sync with latch pulses; an interval, between (i) a latch pulse, in sync with which the piece of video data corresponding to the last horizontal scan in the first group is latched and (ii) a latch pulse, in sync with which the piece of dummy data is latched, is wider than an interval between (i) a latch pulse, in sync with which a piece of video data corresponding to a second last horizontal scan in the first group is latched and (ii) the latch pulse, in sync with the piece of video data corresponding to the last horizontal scan in the first group is latched.

According to the liquid crystal display device of the present invention, a plurality of groups each of which includes a plurality of scanning signal lines are sequentially selected; data signal electric potentials which have identical polarities and correspond to respective plural pieces of video data are sequentially supplied to a data signal line, in response to a plurality of scanning signal lines, which belong to a selected one of the plurality of groups, being sequentially subjected to horizontal scans; a scanning pulse for each of the horizontal scans is supplied to each of the plurality of scanning signal lines; a polarity of the data signal electric potentials for a first group is different from that of a second group, the first and second groups being sequentially selected, the second group being selected after the first group is selected; n-piece (n is an integer of 1 or more) of dummy data is(are) put between (i) a piece of video data corresponding to a last horizontal scan in the first group and (ii) a piece of video data corresponding to a first horizontal scan in the second group; a dummy signal electric potential which corresponds to a piece of dummy data included in the n-piece of dummy data is supplied to the data signal line; and a time period from outputting of a piece of video data corresponding to the last horizontal scan in the first group, after a scanning pulse which corresponds to the last horizontal scan becomes nonactive, to switching to outputting of the piece of dummy data is set to be longer than a time period from outputting of a piece of video data corresponding to one of consecutive two horizontal scans in the first group, after a scanning pulse which corresponds to the one of consecutive two horizontal scans becomes nonactive, to switching to outputting of a piece of video data corresponding to the other of the consecutive two horizontal scans.

According to the liquid crystal display device of the present invention, it is possible that the dummy signal electric potential has a polarity which is identical to a polarity of the data signal electric potentials in the second group.

According to the liquid crystal display device of the present invention, it is possible that the scanning pulse corresponding to the other of the consecutive two horizontal scans becomes active in sync with the scanning pulse corresponding to the one of the consecutive two horizontal scans becoming nonactive.

According to the liquid crystal display device of the present invention, it is possible that outputting of a piece of video data corresponding to an arbitrary horizontal scan is started after a scanning pulse corresponding to the arbitrary horizontal scan becomes active.

According to the liquid crystal display device of the present invention, it is possible that a scanning pulse corresponding to the first horizontal scan in the second group becomes active before outputting of the dummy signal electric potential is started.

According to the liquid crystal display device of the present invention, it is possible that a scanning pulse corresponding to the first horizontal scan in the second group becomes active after outputting of the dummy signal electric potential is started.

According to the liquid crystal display device of the present invention, it is possible that the plural pieces of video data and the piece of dummy data are outputted in sync with latch pulses, in sync with which the plural pieces of video data and the piece of dummy data are latched; an interval, between (i) a latch pulse, in sync with which the piece of video data corresponding to the last horizontal scan in the first group is latched and (ii) a latch pulse, in sync with which the piece of dummy data is latched is wider than an interval between (i) a latch pulse, in sync with which a piece of video data corresponding to a second last horizontal scan in the first group is latched and (ii) the latch pulse, in sync with the piece of video data corresponding to the last horizontal scan in the first group is latched.

According to the liquid crystal display device of the present invention, it is possible that, in a case where a certain scanning signal line is defined as a first scanning signal line in numerical order, one of the first and second groups includes only odd-numbered scanning signal lines, and the other of the first and second groups includes only even-numbered scanning signal lines.

According to the liquid crystal display device of the present invention, it is possible that, in a case where (i) a certain scanning line and its subsequent scanning signal lines are divided into a plurality of blocks and (ii) a block to which the certain scanning line belongs and which is one end block of the plurality of blocks is referred to as a most upstream block and a block which is the other end block is referred to as a most downstream block, scanning signal lines which belong to each of the plurality of blocks are divided into groups, and the plurality of blocks are sequentially selected from groups of the most upstream block to groups of the most downstream block.

According to the liquid crystal display device of the present invention, it is possible that each of a plurality of pixels is made up of a plurality of subpixels. In this case, it is possible that the plurality of subpixels include respective pixel electrodes; retention capacitor lines are provided for the respective pixel electrodes; and a luminance of each of the plurality of subpixels is controlled in response to a retention capacitor line signal supplied to a corresponding one of the retention capacitor lines.

According to the liquid crystal display device of the present invention, at least one dummy scan period is inserted every consecutive horizontal scan periods; a polarity of signal electric potentials supplied to a data signal line is reversed in the at least one dummy scan period following a horizontal scan period; and a previous horizontal scan period of the at least one dummy scan period is set to be longer than a horizontal scan period which is not the previous horizontal scan period.

According to the liquid crystal display device of the present invention, it is possible that a scanning pulse is outputted in each of the horizontal scan periods; and a scanning pulse corresponding to the previous horizontal scan period has a width which is identical to that of a scanning pulse corresponding to the horizontal scan period which is not the previous horizontal scan period.

According to the liquid crystal display device of the present invention, it is possible that the at least one dummy scan period immediately after a horizontal scan period is set to be shorter than the horizontal scan period which is not the previous horizontal scan period.

A method of the present invention for driving a liquid crystal display device, in which device a plurality of groups each of which includes a plurality of scanning signal lines are sequentially selected, data signal electric potentials having identical polarities are sequentially supplied to a data signal line for each horizontal scan period, in response to a plurality of scanning signal lines, which belong to a selected one of the plurality of groups, being sequentially subjected to horizontal scans, the method includes the steps of: supplying a scanning pulse for each of the horizontal scans to each of the plurality of scanning signal lines; causing a polarity of the data signal electric potentials for a first group to be different from that of a second group, the first and second groups being sequentially selected, the second group being selected after the first group is selected; putting n-piece (n is an integer of 1 or more) of dummy scan period(s) between (i) a horizontal scan period corresponding to a last horizontal scan in the first group and (ii) a horizontal scan period corresponding to a first horizontal scan in the second group; supplying a dummy signal electric potential to the data signal line in a dummy scan period included in the n-piece of dummy scan period(s); and causing a time period from a time point when a scanning pulse which corresponds to the last horizontal scan in the first group becomes nonactive to a time point when the dummy scan period is started to be set to be longer than a time period from a time point when a scanning pulse corresponding to one of consecutive two horizontal scans becomes nonactive in the first group to a time point when a horizontal scan period corresponding to the other of the consecutive two horizontal scans is started.

A television receiver of the present invention includes: the above described liquid crystal display device; and a tuner section which receives television broadcasting.

ADVANTAGEOUS EFFECTS OF INVENTION

According to the liquid crystal display device of the present invention, the horizontal scan period corresponding to the last horizontal scan in the first group is set to be longer than the other horizontal scan period. This makes it possible to prevent a phenomenon in which electric charge written into a pixel during the last horizontal scan period is discharged when the dummy scan period following the last horizontal scan period is started. Accordingly, it is possible to reduce the blackish lateral stripes which are the problem seen in the conventional technique.

BRIEF DESCRIPTION OF DRAWINGS

FIG. 1 is a timing chart illustrating a driving example of a liquid crystal display device of Embodiment 1.

FIG. 2 is a schematic view illustrating a configuration of the liquid crystal display device of Embodiment 1.

FIG. 3 is a timing chart for describing the driving example shown in FIG. 1.

FIG. 4 is a schematic view illustrating a polarity distribution of electric potentials written into pixels in a case where the driving example shown in FIG. 3 is used.

FIG. 5 is a timing chart illustrating more details of the driving example shown in FIG. 1.

FIG. 6 is a timing chart illustrating a modification of the driving example shown in FIG. 1.

FIG. 7 is a timing chart illustrating a modification of the driving example shown in FIG. 1.

FIG. 8 is a timing chart illustrating another driving example of the liquid crystal display device of Embodiment 1.

FIG. 9 is a timing chart for describing the driving example shown in FIG. 8.

FIG. 10 is a schematic view illustrating a polarity distribution of electric potentials written into pixels in a case where the driving example shown in FIG. 8 is used.

FIG. 11 is a schematic view illustrating a configuration of the liquid crystal display device of Embodiment 2.

FIG. 12 is a timing chart illustrating a driving example of the liquid crystal display device of Embodiment 2.

FIG. 13 is a timing chart for describing the driving example shown in FIG. 12.

FIG. 14 is a schematic view illustrating a connection relation between retention capacitor lines and retention capacitor trunk lines.

FIG. 15 is a schematic view illustrating a polarity distribution and bright and dark states of electric potentials written into pixels in a case where the driving example shown in FIG. 12 is used.

FIG. 16 is a block diagram illustrating an entire configuration of the liquid crystal display device of the present invention.

FIG. 17 is a block diagram illustrating a function of a television receiver of the present invention.

FIG. 18 is a timing chart illustrating a driving example of a conventional liquid crystal display device.

FIG. 19 is a timing chart for describing a problem of the conventional liquid crystal display device.

FIG. 20 is a schematic view illustrating a display state of the conventional liquid crystal display device.

DESCRIPTION OF EMBODIMENTS

The following describes embodiments of the present invention with reference to FIGS. 1 through 17.

[Embodiment 1]

Figure 2:
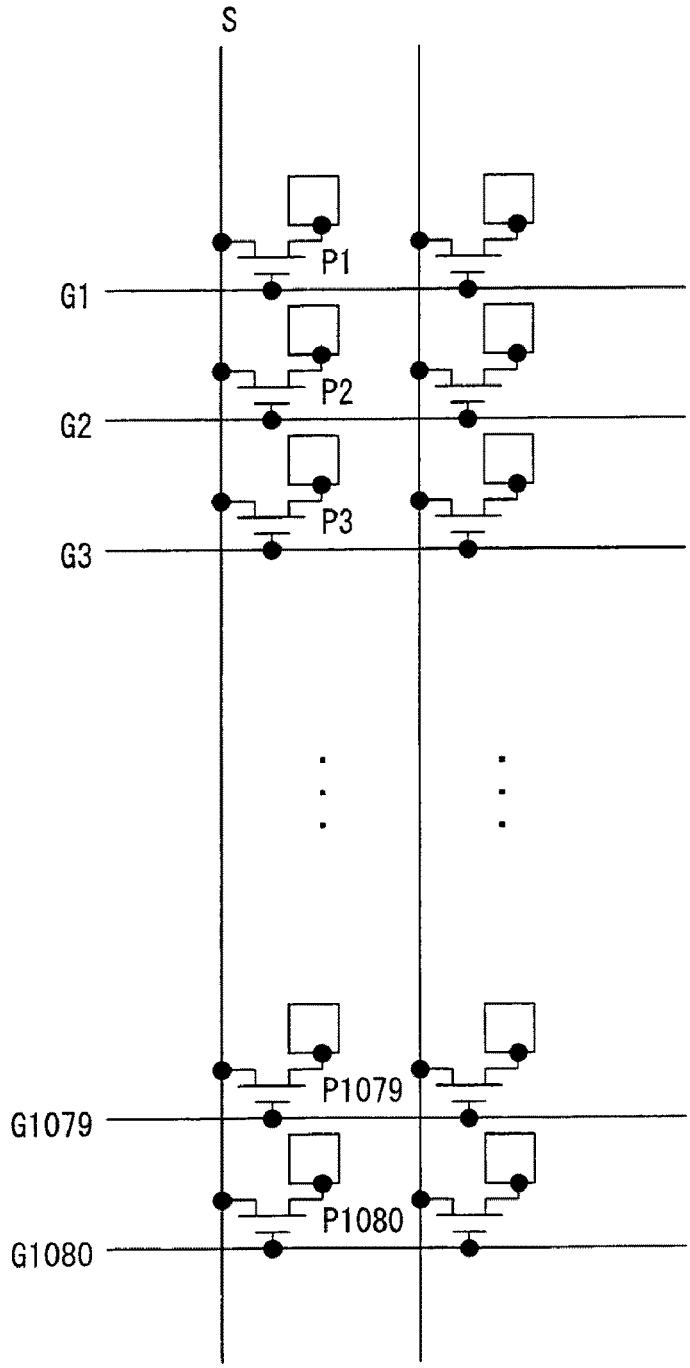
FIG. 2

A liquid crystal display device of Embodiment 1 has a display section (e.g., of a normally black mode) in which (i) pixels are provided in a matrix manner and (ii) scanning signal lines G1 through G1080 are provided (see FIG. 2). For example, a pixel column is made up of pixels P1 through P1080, and a pixel electrode included in a pixel Pi (i is an integer of 1 to 1080) is connected with a scanning signal line Gi and a data signal line S, via a transistor.

Figure 3:
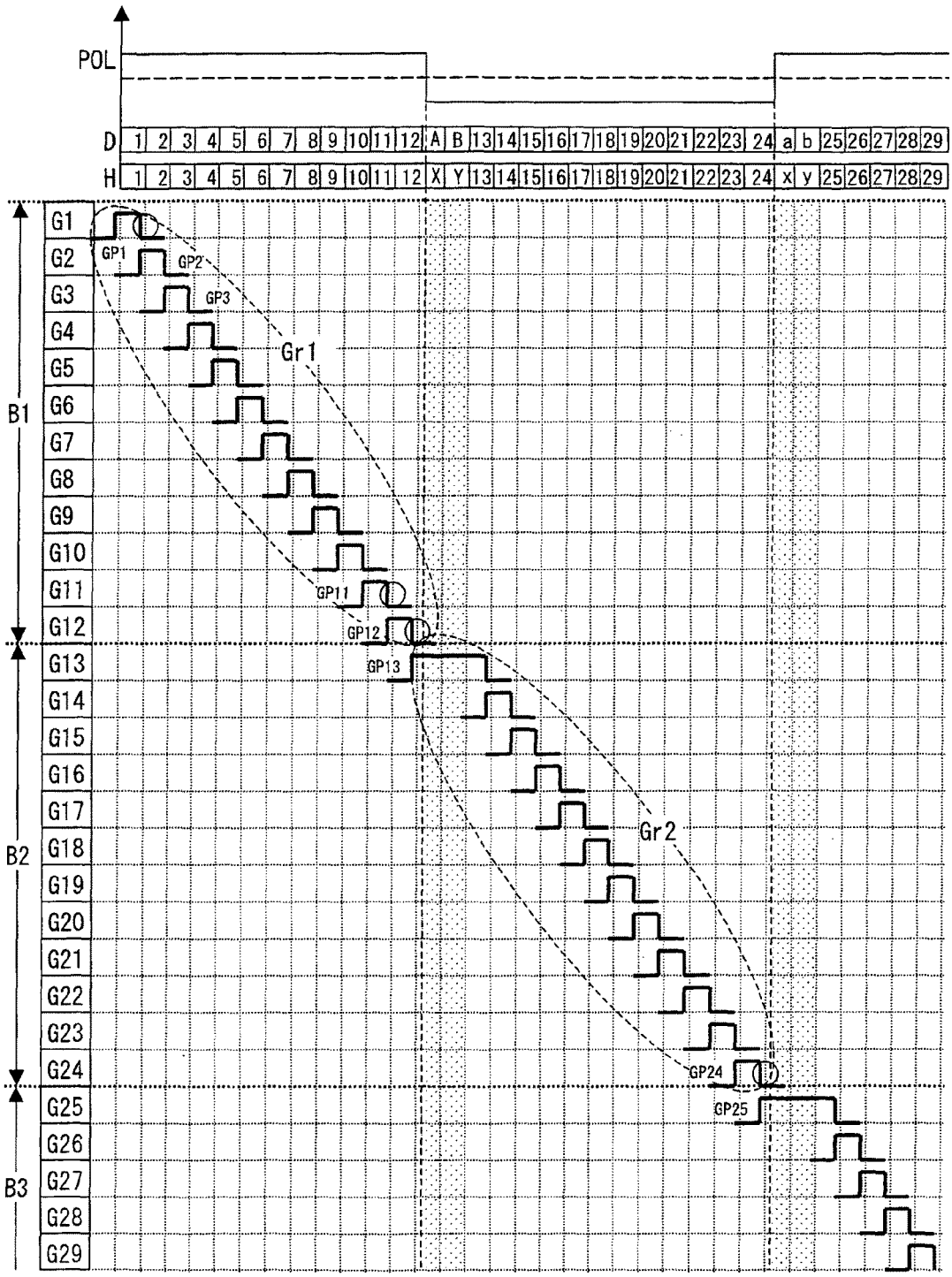
FIG. 3

According to Embodiment 1, the scanning signal lines are sequentially scanned while the data signal line is being subjected to the block-reversal driving (see FIG. 3). First, the scanning signal line G1 and its subsequent scanning signal lines G2 through G1080 are divided into 90 blocks (i.e., blocks B1 through B90) which are demarcated by 89 boundaries extending in parallel with the scanning signal lines G1 through G1080. Each of the blocks B1 through B90 includes 12 scanning signal lines which have respective consecutive numbers. For example, the block B1 which is a most upstream block includes scanning signal lines G1 through G12, the block B2 includes scanning signal lines G13 through G24, the block B3 includes scanning signal lines G25 through G36, and the block B90 which is a most downstream block includes scanning signal lines G1069 through G1080.

The 12 scanning signal lines (G1, G2, . . . , G12) included in the block B1 which is the most upstream block belong to a first group Gr1, and the 12 scanning signal lines (G13, G14, . . . , G24) included in the block B2 which follows the block B1 belong to a group Gr2. Subsequently, 12 scanning signal lines included in the blocks belong to respective groups Gr3 through Gr90. The groups Gr1 through Gr90 are sequentially selected from the group Gr1 to the group Gr90. During the sequential selection, data signal electric potentials having identical polarities are sequentially supplied to a data signal line for each horizontal scan period, in response to 12 scanning signal lines, which belong to a selected one of the groups Gr1 through Gr90, being sequentially subjected to horizontal scans (gate pulses being sequentially supplied to the respective 12 scanning signal lines). Note that a polarity (positive or negative) of data signal electric potentials for a first group is different from that of a second group, the first and second groups being sequentially selected, the second group being selected after the first group is selected. Note that pieces of data D1, D2, D3, . . . are pieces of video data (digital data) which respectively correspond to the pixel P1 connected to the scanning signal line G1, the pixel P2 connected to the scanning signal line G2, . . . (see FIG. 2). A polarity-reversal signal POL is a signal which controls a polarity of a signal electric potential supplied to the data signal line S.

Figure 4:
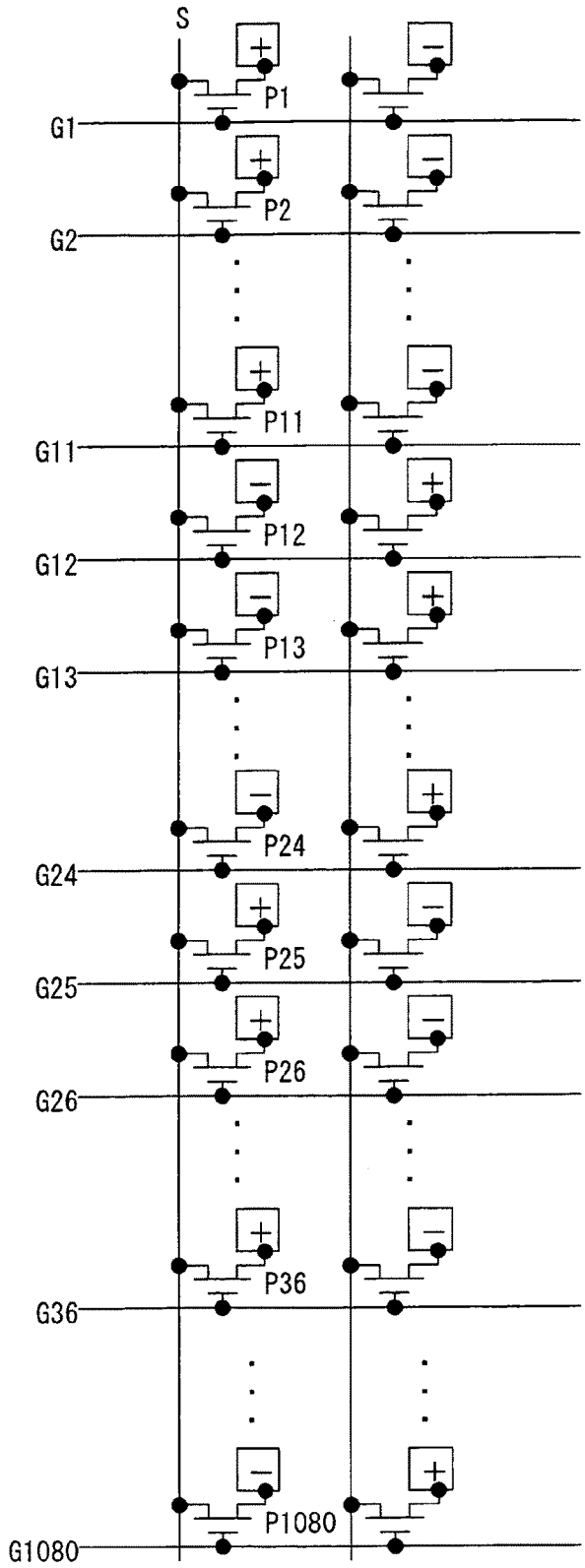
FIG. 4

Specifically, while the group Gr1 is being selected, the scanning signal lines G1 through G12, which belong to the selected group Gr1, are sequentially subjected to horizontal scans (i.e., gate pulses GP1 through GP12 are sequentially supplied to the scanning signal lines G1 through G12, respectively). During the horizontal scans, data signal electric potentials, which have a positive polarity and correspond to respective pieces of video data D1 through D12, are supplied to the data signal line S during respective horizontal scan periods H1 through H12. Subsequently, while the group Gr2 is being selected, the scanning signal lines G13 through G24, which belong to the selected group Gr2, are sequentially subjected to horizontal scans (i.e., gate pulses GP13 through GP24 are sequentially supplied to the scanning signal lines G13 through G24, respectively). During the horizontal scans, data signal electric potentials, which have a negative polarity and correspond to respective pieces of video data D13 through D24, are supplied to the data signal line S during respective horizontal scan periods H13 through H24. Then, while the group Gr3 is being selected, the scanning signal lines G25 through G36, which belong to the selected group Gr3, are sequentially subjected to horizontal scans. During the horizontal scans, data signal electric potentials, which have a positive polarity and correspond to respective pieces of video data D25 through D36, are supplied to the data signal line S during respective horizontal scan periods H25 through H36. Consequently, a polarity distribution of electric potentials of respective pixels in the display section becomes as shown in FIG. 4.

Moreover, first and second dummy scan periods are put between (i) a horizontal scan period corresponding to a last horizontal scan in the first group and (ii) a horizontal scan period corresponding to a first horizontal scan in the second group, the second group being selected after the first group is selected. In each of the dummy scan periods, a dummy signal electric potential is supplied to a data signal line.

For example, a first dummy scan period HX and a second dummy scan period HY are put between the horizontal scan period H12 and the horizontal scan period H13. The horizontal scan period H12 corresponds to the last horizontal scan in the group Gr1, and the horizontal scan period H13 corresponds to the first horizontal scan in the group Gr2. The first and second groups are consecutively selected in this order. Moreover, pieces of dummy data DA and DB are put between pieces of video data D12 and D13. In the first dummy scan period HX, a dummy signal electric potential corresponding to the dummy data DA (e.g., data identical to the video data D13) is supplied to the data signal line S. In the second dummy scan period HY, a dummy signal electric potential corresponding to the dummy data DB (e.g., data identical to the video data D13) is supplied to the data signal line S. Similarly, a first dummy scan period Hx and a second dummy scan period Hy are put between a horizontal scan period H24 and a horizontal scan period H25. Moreover, pieces of dummy data Da and Db are put between the pieces of video data D24 and D25. In the first dummy scan period Hx, a dummy signal electric potential corresponding to the dummy data Da (e.g., data identical to the video data D25) is supplied to the data signal line S. In the second dummy scan period HY, a dummy signal electric potential corresponding to the dummy data DB (e.g., data identical to the video data D13) is supplied to the data signal line S.

Note here that, in a case where consecutive first and second horizontal scans are carried out in this order in each of the groups, a gate pulse corresponding to the second horizontal scan becomes active in sync with a gate pulse, which corresponds to the first horizontal scan, becoming nonactive. Note also that a horizontal scan period corresponding to an arbitrary horizontal scan is started after a gate pulse, which corresponds to the arbitrary horizontal scan, becomes active, and the horizontal scan period corresponding to the arbitrary horizontal scan is ended after the gate pulse becomes nonactive.

For example, the gate pulse GP2 becomes active (rises) in sync with the gate pulse GP1 becoming nonactive (falls), and the gate pulse GP3 becomes active in sync with the gate pulse GP2 becoming nonactive. Moreover, the horizontal scan period H1 is started after the gate pulse GP1 becomes active, and the horizontal scan period H1 is ended after the gate pulse GP1 becomes nonactive. Moreover, the horizontal scan period H2 is started after the gate pulse GP2 becomes active, and the horizontal scan period H2 is ended after the gate pulse GP2 becomes nonactive. Note that the gate pulse GP13 becomes active in sync with the gate pulse GP12 becoming nonactive, and after the first and second dummy scan periods HX and HY, the gate pulse GP13 becomes nonactive in sync with the gate pulse GP14 becoming active.

It should be noted here that, in a case where first and second groups are consecutively selected in this order, a time period from a time point when a gate pulse which corresponds to the last horizontal scan in the first group becomes nonactive to a time point when a dummy scan period is started is set to be longer than a time period from a time point when a gate pulse corresponding to one of consecutive two horizontal scans becomes nonactive in the first group to a time point when a horizontal scan period corresponding to the other of the consecutive two horizontal scans is started. In other words, a time period from a time point when a scanning pulse which corresponds to the last horizontal scan in the first group becomes nonactive to a time point when outputting of image data corresponding to the last horizontal scan is switched to outputting of dummy data is set to be longer than a time period from a time point when a scanning pulse corresponding to one of consecutive two horizontal scans becomes nonactive in the first group to a time point when outputting of image data corresponding to the one of the consecutive two horizontal scans is switched to outputting of image data corresponding to the other of the consecutive two horizontal scans.

Specifically, a time period from a time point when the gate pulse GP12 corresponding to the last horizontal scan in the group Gr1 becomes nonactive (falls) to a time point when the first dummy scan period HX is started (i.e., outputting of D12 is switched to outputting of DA) is set to be longer than a time period from a time point when the gate pulse GP1 becomes nonactive (falls) to a time point when the horizontal scan period H2 is started (i.e., outputting of D1 is switched to outputting of D2); and a time period from a time point when the gate pulse GP24 corresponding to the last horizontal scan in the group Gr2 becomes nonactive (falls) to a time point when the first dummy scan period Hx is started (i.e., outputting of D24 is switched to outputting of Da) is set to be longer than a time period from a time point when a gate pulse GP11 becomes nonactive (falls) to a time point when the horizontal scan period H12 is started (i.e., outputting of D11 is switched to outputting of D12). The following describes this effect with reference to FIG. 1.

Figure 1:
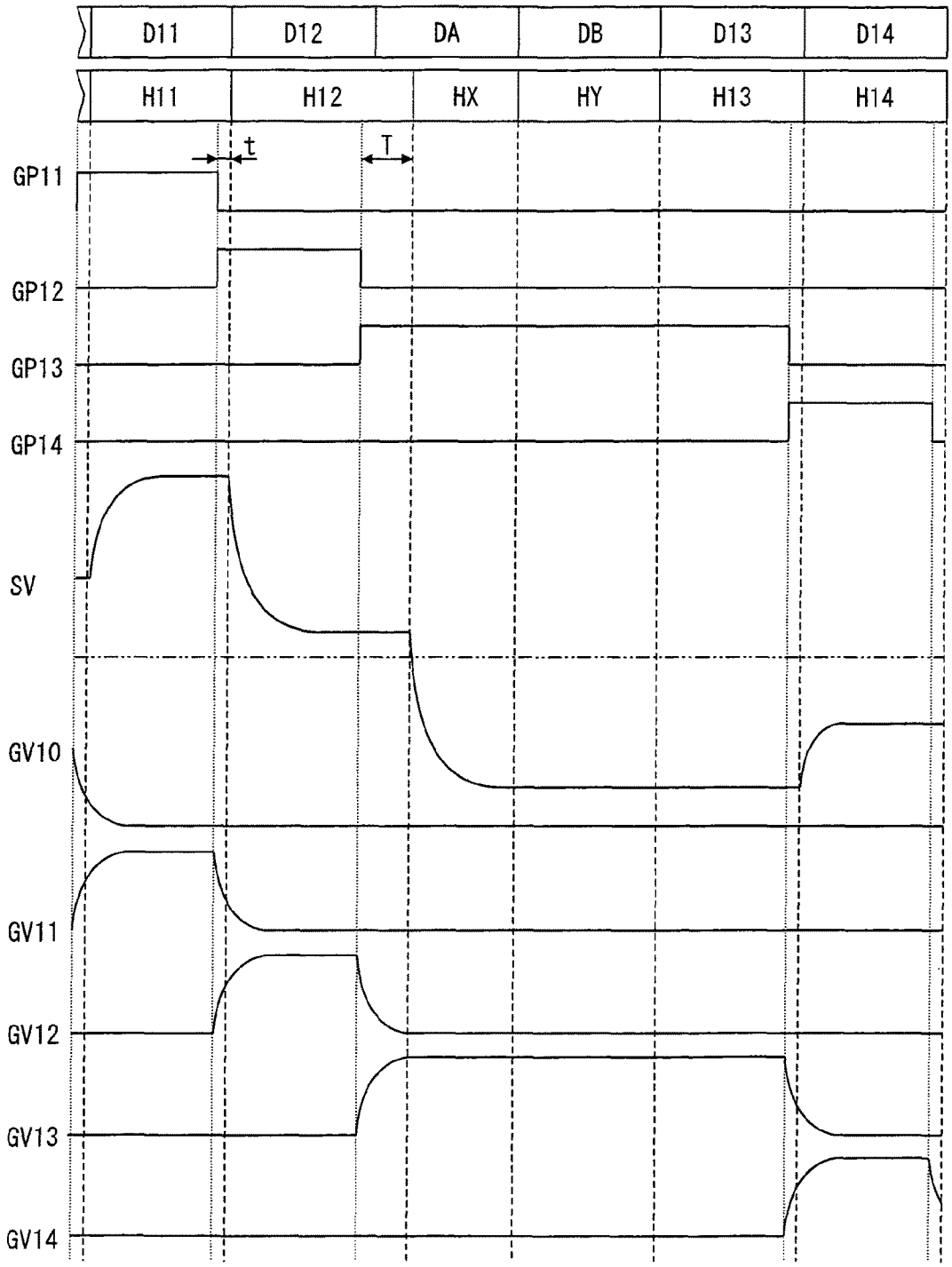
FIG. 1

As shown in FIG. 1, the horizontal scan period H11 (a time period during which a data signal electric potential which has a positive polarity and corresponds to the video data D11 is being supplied to the data signal line S) is started after the gate pulse GP11 becomes active, and then the horizontal scan period H11 is ended after a time period t is elapsed since the gate pulse GP11 becomes nonactive. The horizontal scan period H12 (a time period during which a data signal electric potential which has a positive polarity and corresponds to the video data D12 is being supplied to the data signal line S) is started concurrently with the horizontal scan period H11 being ended. Note that a TFT of a pixel P12 connected to the scanning signal line G12 is turning on during at least part of the time period t. This is because the gate pulse GP12 becomes active in sync with the gate pulse GP11 becoming nonactive. Therefore, in a case where the time period t is too long, an image to be displayed on the pixel 11 is temporarily displayed on the pixel P12, which is visually recognized as a phenomenon called ghost.

As described above, the gate pulse GP 12 becomes active in sync with the gate pulse GP11 becoming nonactive. Then, the horizontal scan period H12 (a time period during which a data signal electric potential which has a positive polarity and corresponds to the video data D12 is being supplied to the data signal line S) is started. The horizontal scan period H12 is ended after a time period T (>t) is elapsed since the gate pulse GP12 becomes nonactive. The dummy scan period HX is started concurrently with the horizontal scan period H12 being ended.

Note here that, even though the gate pulse GP12 becomes nonactive, an electric potential GV12 of the scanning signal line G12 does not fall precipitously but falls while becoming dull due to parasitic resistor and parasitic capacitor. That is, the TFT of the pixel P12 connected to the scanning signal line G12 is turning on for a while (during a dull period) after the gate pulse GP12 becomes nonactive.

Figure 20:
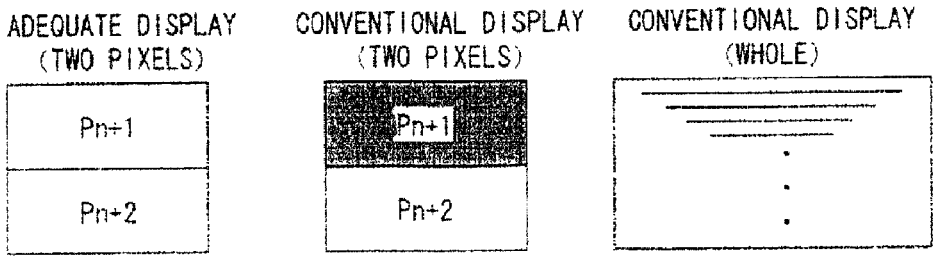
FIG. 20

In view of the circumstances, the time period T from a time point when the gate pulse GP12 becomes nonactive to a time point when the dummy scan period HX (a time period during which a dummy signal electric potential which has a negative polarity and corresponds to the dummy data DA is being supplied to the data signal line S) is started is set to be longer than the time period t (i.e., the horizontal scan period H12 is extended). This allows the horizontal scan period H12 to contain the dull period (most part of the dull period) of the electric potential GV12 of the scanning signal line G12. Accordingly, it is possible to prevent a phenomenon in which positive electric charge written into the pixel P12 during the horizontal scan period H12 is discharged by the dummy scan period HX being started. This makes it possible to reduce blackish lateral stripes (see FIG. 20) which have been the problem of a conventional display.

Note that the time periods t and T are set based on, for example, a degree of dullness of the electric potential GV12 which is applied to the scanning signal line (a time constant of the scanning signal line), a degree of dullness of a data signal electric potential SV (a time constant of the data signal line), and a characteristic of a source driver. For example, t=2 [μs], and T=5 [μs]. Note that it is preferable to set (T−t) (extended time period of the horizontal scan period H12 with respect to the other horizontal scan period) to be, for example, a time period from a time point when the gate pulse GP12 supplied to the scanning signal line G12 becomes nonactive to a time point when the electric potential GV12 of the scanning signal line G12 falls to a nonactive (low) electric potential.

Figure 5:
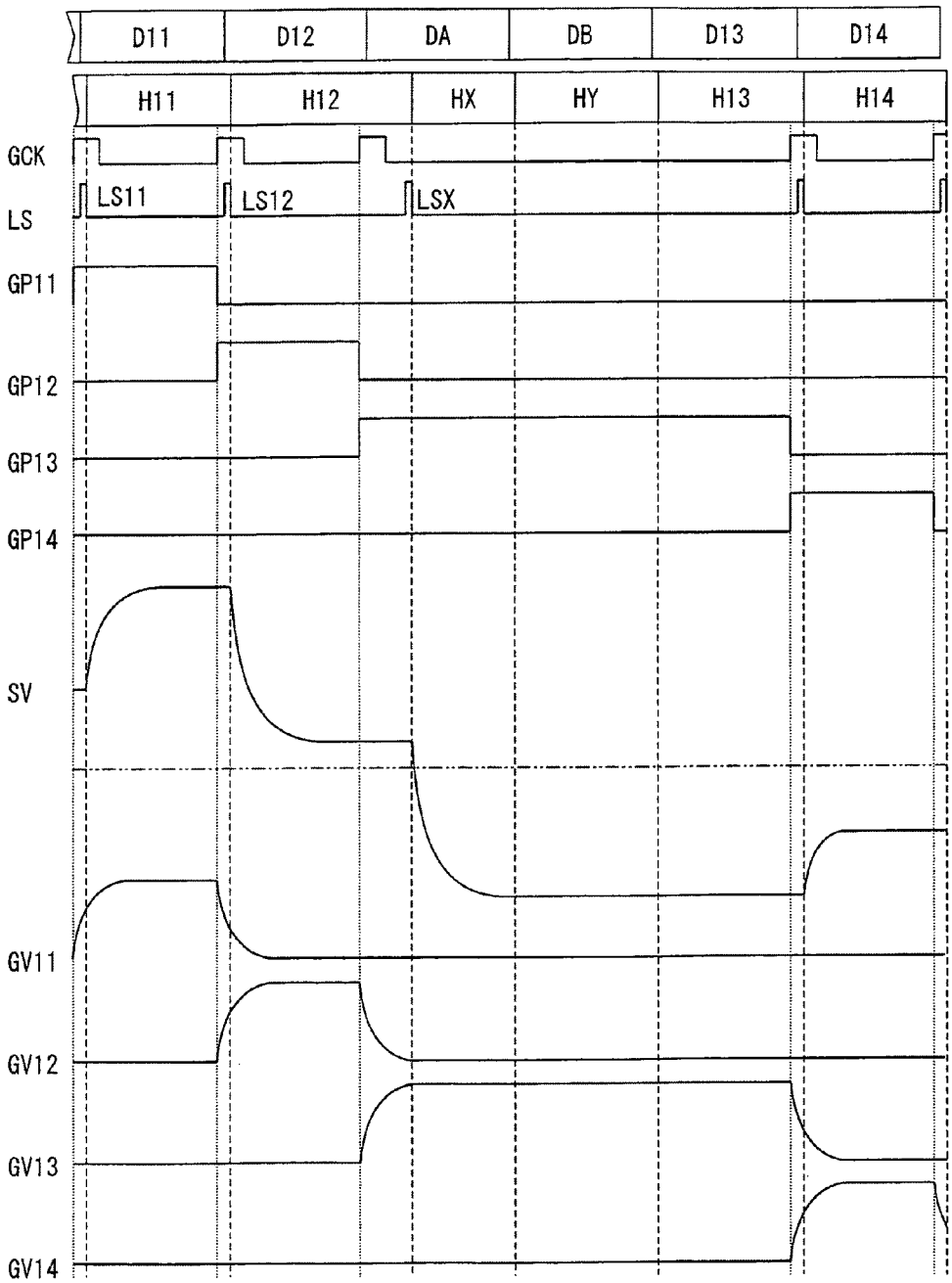
FIG. 5
Figure 6:
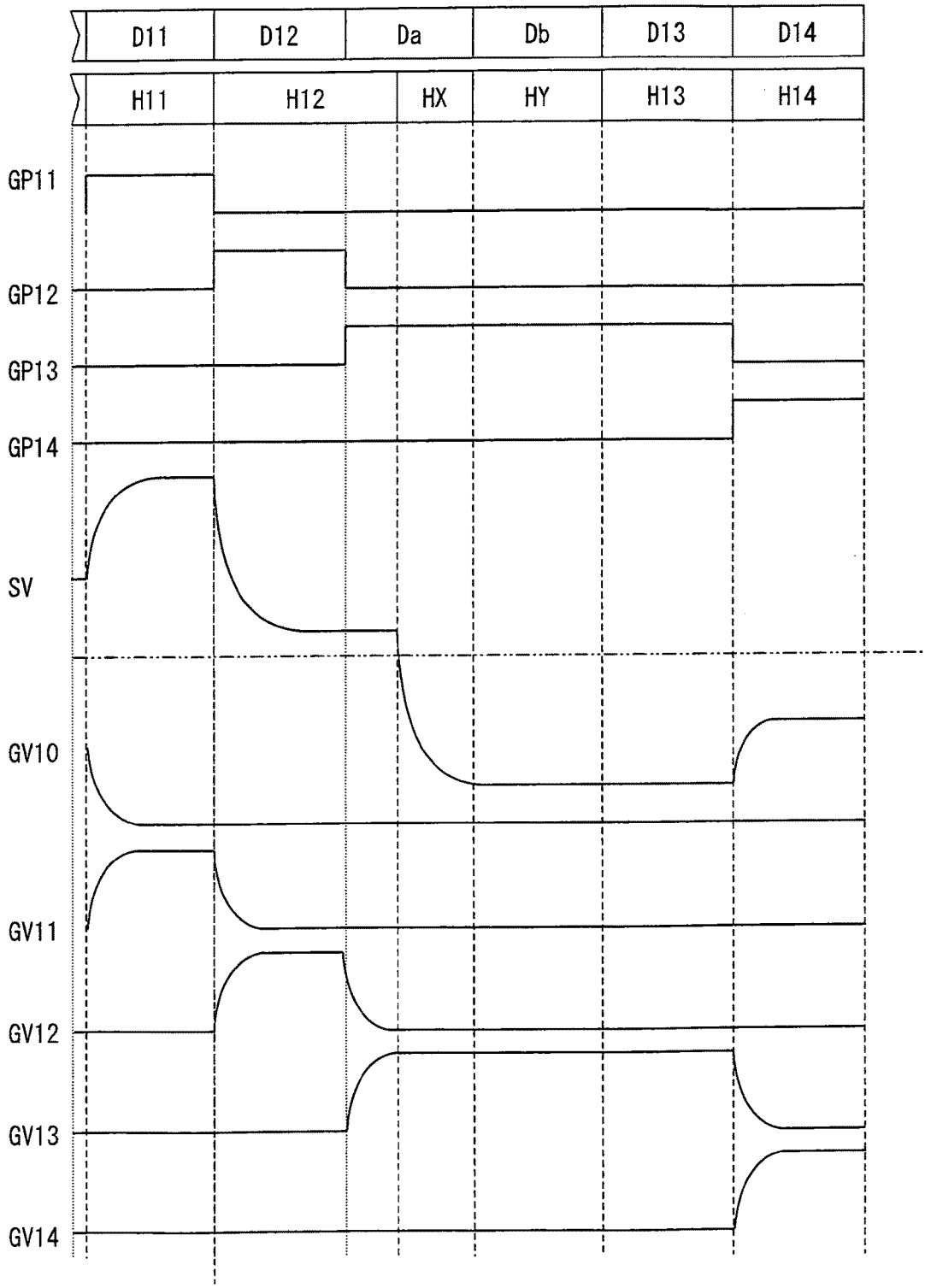
FIG. 6
Figure 7:
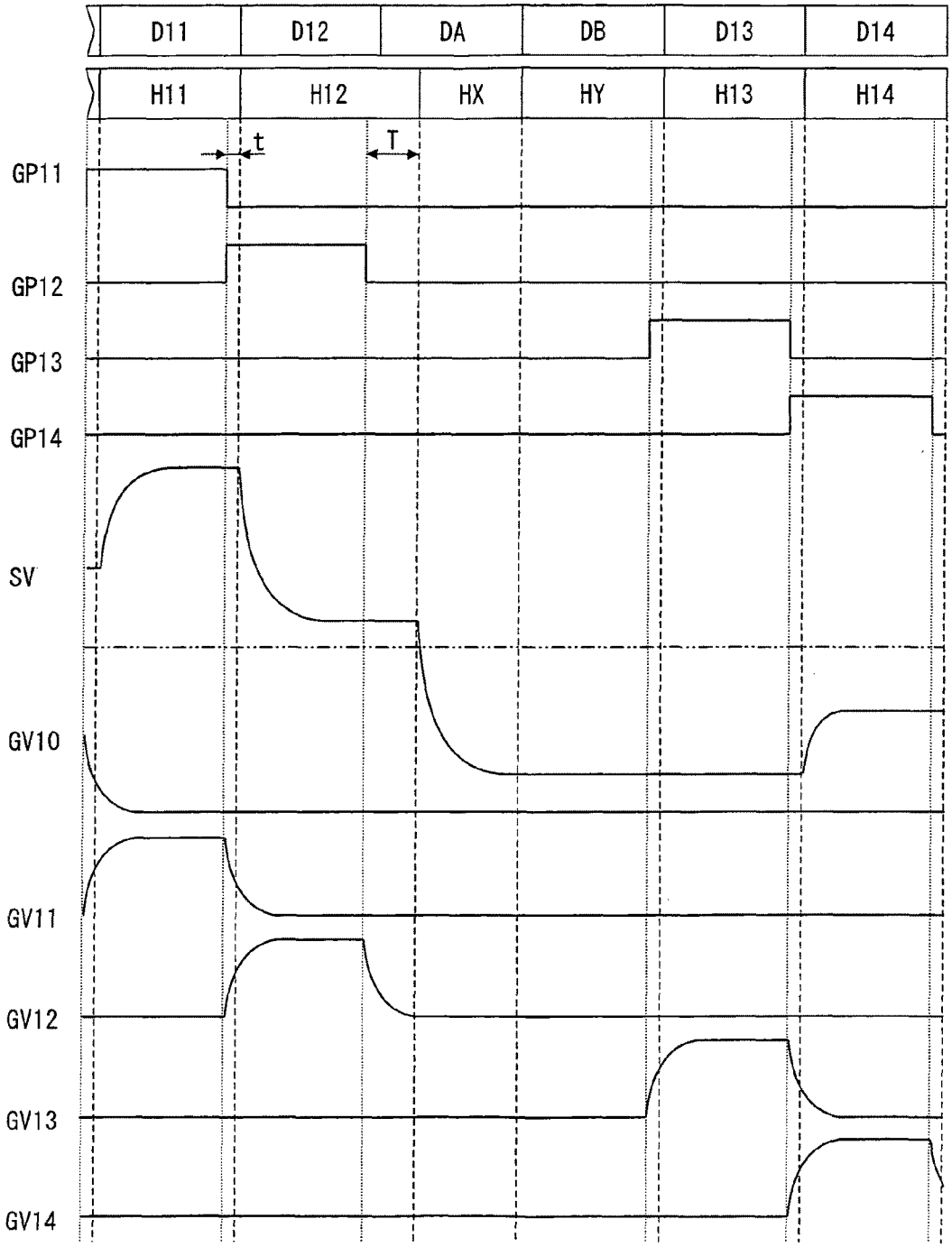
FIG. 7

FIG. 5 is a timing chart illustrating a case where a gate pulse is generated based on a gate clock GCK, and a horizontal scan period is defined by a latch strobe (latch pulse) signal LS. In this case, a rising edge of one of adjacent two gate clocks is in sync with a rising edge (activation) of a certain gate pulse, and a rising edge of the other of the adjacent two gate clocks is in sync with a falling edge (nonactivation) of the certain gate pulse. Moreover, the video data and the dummy data are latched in sync with rising edges of respective latch pulses, and signal electric potentials (data signal electric potentials and dummy signal electric potentials) are supplied to the data signal line S in sync with falling edges of the respective latch pulses. For example, the outputting of a data signal electric potential (horizontal scan period H11) corresponding to the video data D11 is started in sync with the falling edge of a latch pulse LS11. In sync with the falling edge of a latch pulse LS12, (i) the outputting of a data signal electric potential (horizontal scan period H12) corresponding to the video data D12 is started and (ii) the outputting of the data signal electric potential (horizontal scan period H11) corresponding to the video data D11 is ended. In sync with the falling edge of a latch pulse LSX, (i) the outputting of a dummy signal electric potential (dummy scan period HX) corresponding to the dummy data DA is started and (ii) the outputting of the data signal electric potential (horizontal scan period H12) corresponding to the video data D12 is ended. It is therefore possible to satisfy T>t (T: the time period from a time point when the gate pulse G12 becomes nonactive to a time period when the dummy scan period HX is started, t: time period from a time point when a gate pulse corresponding to one of consecutive two horizontal scans becomes nonactive to a time point when a horizontal scan period corresponding to the other of the consecutive two horizontal scans is started), by setting an interval between the latch pulse LS12 and the latch pulse LSX to be wider than an interval between the latch pulse LS11 and the latch pulse LS12.

In this case, it is preferable to reduce, by a time period corresponding to the extension of the horizontal scan period H12, the dummy scan period HX (i.e., HX<HY) which follows the horizontal scan period H12. For example, a sum of the horizontal scan period H12 and the dummy scan period HX is set to be, for example, twice as long as the horizontal scan period H11 (=HY). This makes it possible to extend the horizontal scan period H12 only by changing the setting of the latch strobe signal LS (changing the position of the latch pulse LSX), instead of changing input intervals of the video data and the dummy data.

According to FIG. 1, the time period t (time period from a time point when a gate pulse corresponding to one of consecutive two horizontal scans becomes nonactive to a time point when a horizontal scan period corresponding to the other of the consecutive two horizontal scans is started) is set to be a predetermined time period (e.g., 2 μs). However, the present embodiment is not limited to this. For example, it is possible to set the time period t≈0 (see FIG. 6).

According to FIG. 1, a gate pulse corresponding to a first horizontal scan of a group becomes active before a dummy scan period is started (i.e., the gate pulse GP13 becomes active in sync with the gate pulse GP12 becoming nonactive, and after the first and second dummy scan periods HX and HY, the gate pulse GP13 becomes nonactive in sync with the gate pulse GP14 becoming active). However, the present embodiment is not limited to this. The gate pulse corresponding to the first horizontal scan of the group can become active after the dummy scan period is started. For example, the gate pulse GP13 does not become active in sync with the gate pulse GP12 becoming nonactive but becomes active immediately before the second dummy scan period HY is ended (horizontal scan period H13 is started) (see FIG. 7).

In a case where a scanning signal line (e.g., G13 or G25) which is firstly subjected to a horizontal scan in a group is insufficiently charged, it is preferable. that a gate pulse (e.g., GP13) corresponding to the first horizontal scan of the group becomes active before the dummy scan period is started (see FIG. 1). In a case where a scanning signal line (e.g., G13 or G25) which is firstly subjected to a horizontal scan in a group is excessively charged, it is preferable that a gate pulse corresponding to the first horizontal scan of the group becomes active after the dummy scan period is started (see FIG. 7).

Figure 8:
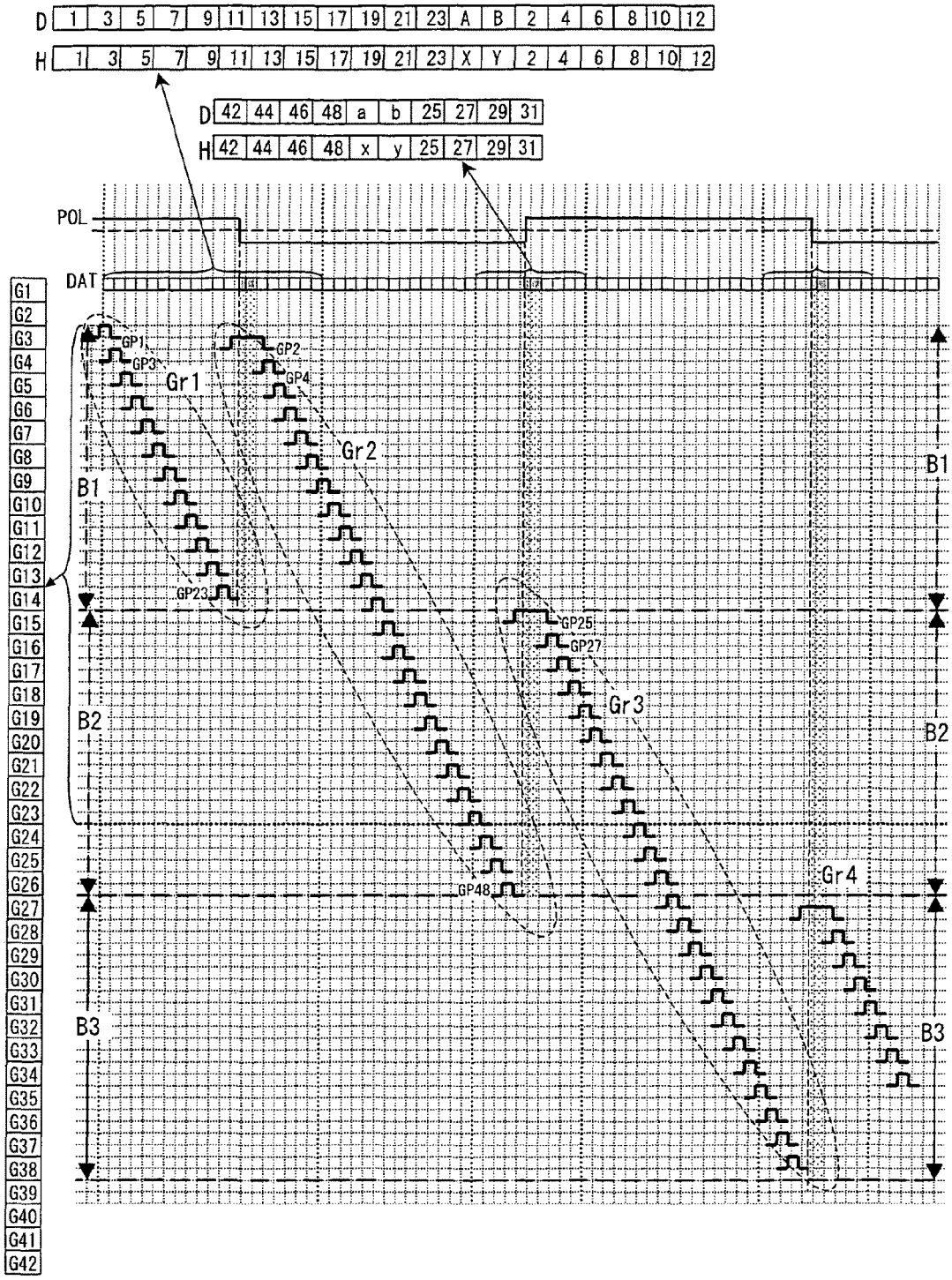
FIG. 8

According to the present embodiment, it is possible to carry out interlaced scanning with respect to the scanning signal lines while carrying out the block-reversal driving with respect to the data signal line (see FIG. 8). In this case, it is assumed that the scanning signal line G1 and the following scanning signal lines in the display section are divided into 45 blocks (B1 through B45) demarcated by 44 boundaries extending in parallel with the scanning signal lines. Each of the 45 blocks B1 through B45 includes 24 scanning signal lines which have respective consecutive numbers. For example, the block B1 which is a most upstream block includes scanning signal lines G1 through G24, the block B2 includes scanning signal lines G25 through G48, the block B3 includes scanning signal lines G49 through G72, and the block B45 which is a most downstream block includes scanning signal lines G1057 through G1080.

Moreover, odd-numbered 12 scanning signal lines (G1, G3, . . . , G23) included in the block B1 which is the most upstream block belong to a first group Gr1, and even-numbered 24 scanning signal lines (G2, G4, . . . , G48) included in the block B1 and the block B2 which follows the block B1 belong to a group Gr2. Odd-numbered 24 scanning signal lines (G25, G27, . . . , G71) included in the second block B2 and the block B3 which follows the block B2 belong to a group Gr3. Subsequently, groups Gr4 through G45 are prepared by (i) grouping even-numbered 24 scanning signal lines included in a block Bj (j is an odd number between 3 through 43) and a following block B(j+1) and (ii) grouping odd-numbered 24 scanning signal lines included in the block B(j+1) and a following block B(j+2), in turn. A last group Gr46 includes even-numbered 12 scanning signal lines (G1058, G1060, . . . , G1080) included in the block B45 which is the most downstream block. The groups Gr1 through Gr46 are sequentially selected from the group Gr1 to the group Gr46. During the sequential selection, data signal electric potentials having identical polarities are sequentially supplied to a data signal line for each horizontal scan period, in response to the scanning signal lines, which belong to a selected one of the groups Gr1 through Gr46, being sequentially subjected to horizontal scans (gate pulses being sequentially supplied to the respective scanning signal lines). Note that a polarity (positive or negative) of data signal electric potentials for a first group is different from that of a second group, the first and second groups being sequentially selected, the second group being selected after the first group is selected.

Figure 10:
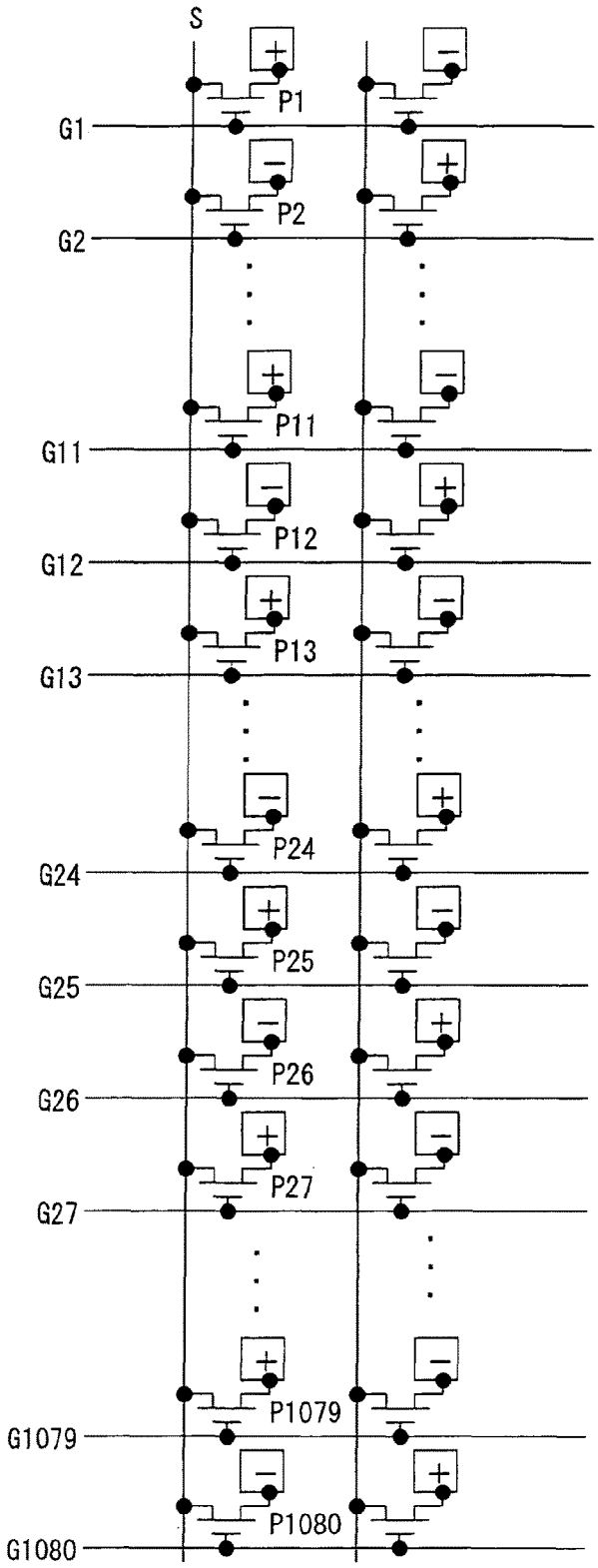
FIG. 10
Figure 11:
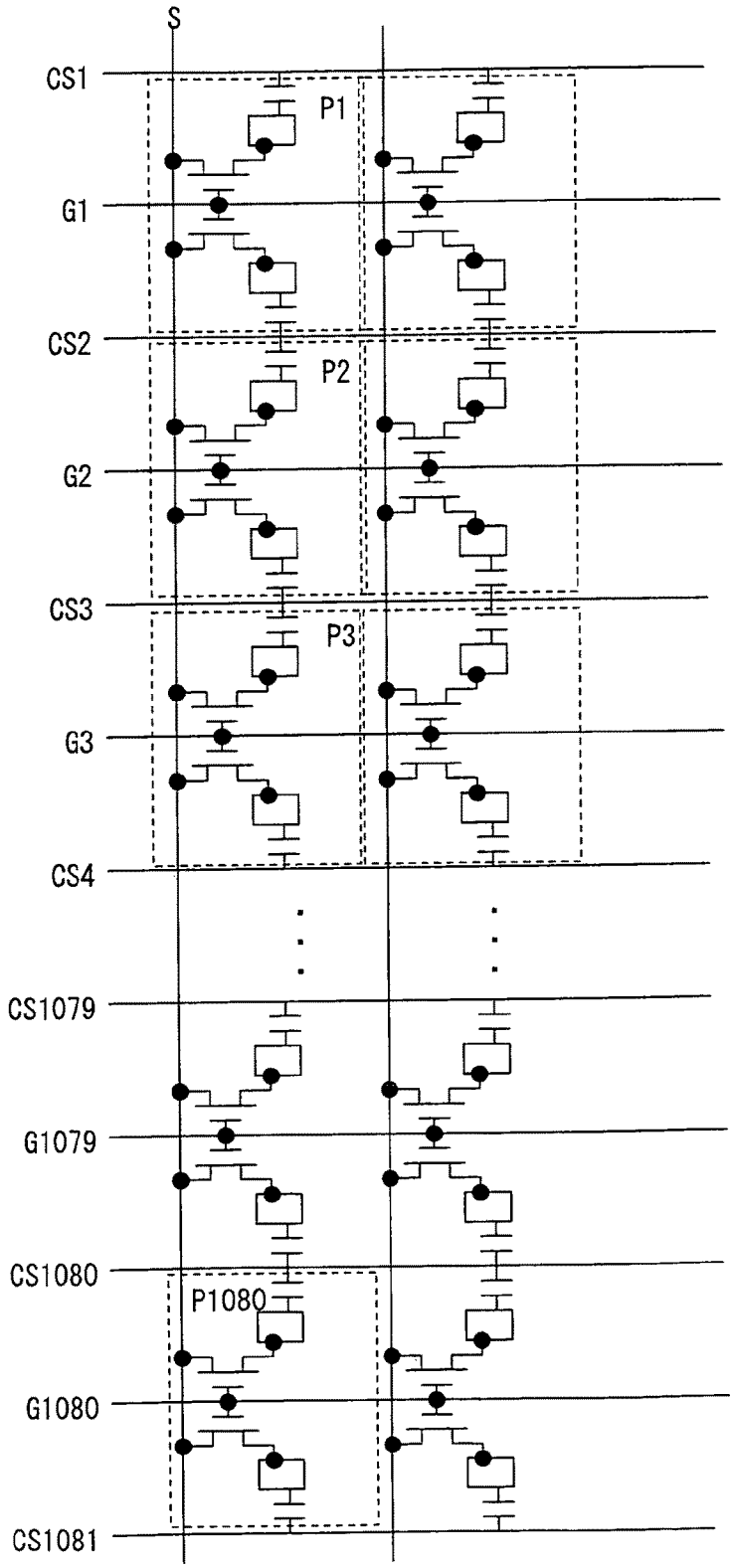
FIG. 11

Specifically, while the group Gr1 is being selected, the scanning signal lines G1, G3, . . . , G23, which belong to the selected group Gr1, are sequentially subjected to horizontal scans (i.e., gate pulses GP1, GP3, . . . , GP23 are sequentially supplied to the scanning signal lines G1, G3, . . . , G23, respectively). During the horizontal scans, data signal electric potentials, which have a positive polarity and correspond to respective pieces of video data D1, D3, . . . , D23, are supplied to the data signal line S during respective horizontal scan periods. Subsequently, while the group Gr2 is being selected, the scanning signal lines G2, G4, . . . , G48, which belong to the selected group Gr2, are sequentially subjected to horizontal scans (i.e., gate pulses GP2, GP4, . . . , GP48 are sequentially supplied to the scanning signal lines G2, G4, . . . , G48, respectively). During the horizontal scans, data signal electric potentials, which have a negative polarity and correspond to respective pieces of video data D2, D4, . . . , D48, are supplied to the data signal line S during respective horizontal scan periods. Then, while the group Gr3 is being selected, the scanning signal lines G25, G27, . . . , which belong to the selected group Gr3, are sequentially subjected to horizontal scans (i.e., gate pulses GP25, GP27, . . . are sequentially supplied to the scanning signal lines G25, G27, . . . , respectively). During the horizontal scans, data signal electric potentials, which has a positive polarity and correspond to respective pieces of video data D25, D27, . . . , are supplied to the data signal line S during respective horizontal scan periods. Consequently, a polarity distribution of electric potentials of respective pixels in the display section becomes as shown in FIG. 10.

Moreover, first and second dummy scan periods are put between (i) a horizontal scan period corresponding to a last horizontal scan in the first group and (ii) a horizontal scan period corresponding to a first horizontal scan in the second group, the second group being selected after the first group is selected. In each of the dummy scan periods, a dummy signal electric potential is supplied to a data signal line.

For example, a first dummy scan period HX and a second dummy scan period HY are put between the horizontal scan period H23 and the horizontal scan period H2. The horizontal scan period H23 corresponds to the last horizontal scan in the group Gr1, and the horizontal scan period H2 corresponds to the first horizontal scan in the group Gr2. The first and second groups are consecutively selected in this order. Moreover, pieces of dummy data DA and DB are put between pieces of video data D23 and D2. In the first dummy scan period HX, a dummy signal electric potential corresponding to the dummy data DA (e.g., data identical to the video data D2) is supplied to the data signal line S. In the second dummy scan period HY, a dummy signal electric potential corresponding to the dummy data DB (e.g., data identical to the video data D2) is supplied to the data signal line S. Similarly, a first dummy scan period Hx and a second dummy scan period Hy are put between a horizontal scan period H48 and a horizontal scan period H25. Moreover, pieces of dummy data Da and Db are put between the pieces of video data D48 and D25. In the first dummy scan period Hx, a dummy signal electric potential corresponding to the dummy data Da (e.g., data identical to the video data D25) is supplied to the data signal line S. In the second dummy scan period HY, a dummy signal electric potential corresponding to the dummy data Db (e.g., data identical to the video data D25) is supplied to the data signal line S.

Note here that, in case where consecutive first and second horizontal scans are carried out in this order in each of the groups, a gate pulse corresponding to the second horizontal scan becomes active in sync with a gate pulse, which corresponds to the first horizontal scan, becoming nonactive. Note also that, a horizontal scan period corresponding to an arbitrary horizontal scan is started after a gate pulse, which corresponds to the arbitrary horizontal scan, becomes active, and the horizontal scan period corresponding to the arbitrary horizontal scan is ended after the gate pulse becomes nonactive.

For example, the gate pulse GP3 becomes active (rises) in sync with the gate pulse GP1 becoming nonactive (falls), and the gate pulse GP5 becomes active in sync with the gate pulse GP3 becoming nonactive. Moreover, the horizontal scan period H1 is started after the gate pulse GP1 becomes active, and the horizontal scan period H1 is ended after the gate pulse GP1 becomes nonactive. Moreover, the horizontal scan period H3 is started after the gate pulse GP3 becomes active, and the horizontal scan period H3 is ended after the gate pulse GP3 becomes nonactive. Note that the gate pulse GP2 becomes active in sync with a gate pulse GP23 becoming nonactive, and after the first and second dummy scan periods HX and HY, the gate pulse GP2 becomes nonactive in sync with the gate pulse GP4 becoming active.

It should be noted here that, in a case where first and second groups are consecutively selected in this order, a time period from a time point when a gate pulse which corresponds to the last horizontal scan in the first group becomes nonactive to a time point when a dummy scan period is started is set to be longer than a time period from a time point when a gate pulse corresponding to one of consecutive two horizontal scans becomes nonactive in the first group to a time point when a horizontal scan period corresponding to the other of the consecutive two horizontal scans is started.

Specifically, a time period from a time point when the gate pulse GP23 corresponding to the last horizontal scan in the group Gr1 becomes nonactive (falls) to a time point when the first dummy scan period HX is started is set to be longer than a time period from a time point when the gate pulse GP1 becomes nonactive (falls) to a time point when the horizontal scan period H3 is started; and a time period from a time point when the gate pulse GP48 corresponding to the last horizontal scan in the group Gr2 becomes nonactive (falls) to a time point when the first dummy scan period Hx is started is set to be longer than a time period from a time point when a gate pulse GP21 becomes nonactive (falls) to a time point when the horizontal scan period H23 is started. The following describes this feature with reference to FIG. 9.

Figure 9:
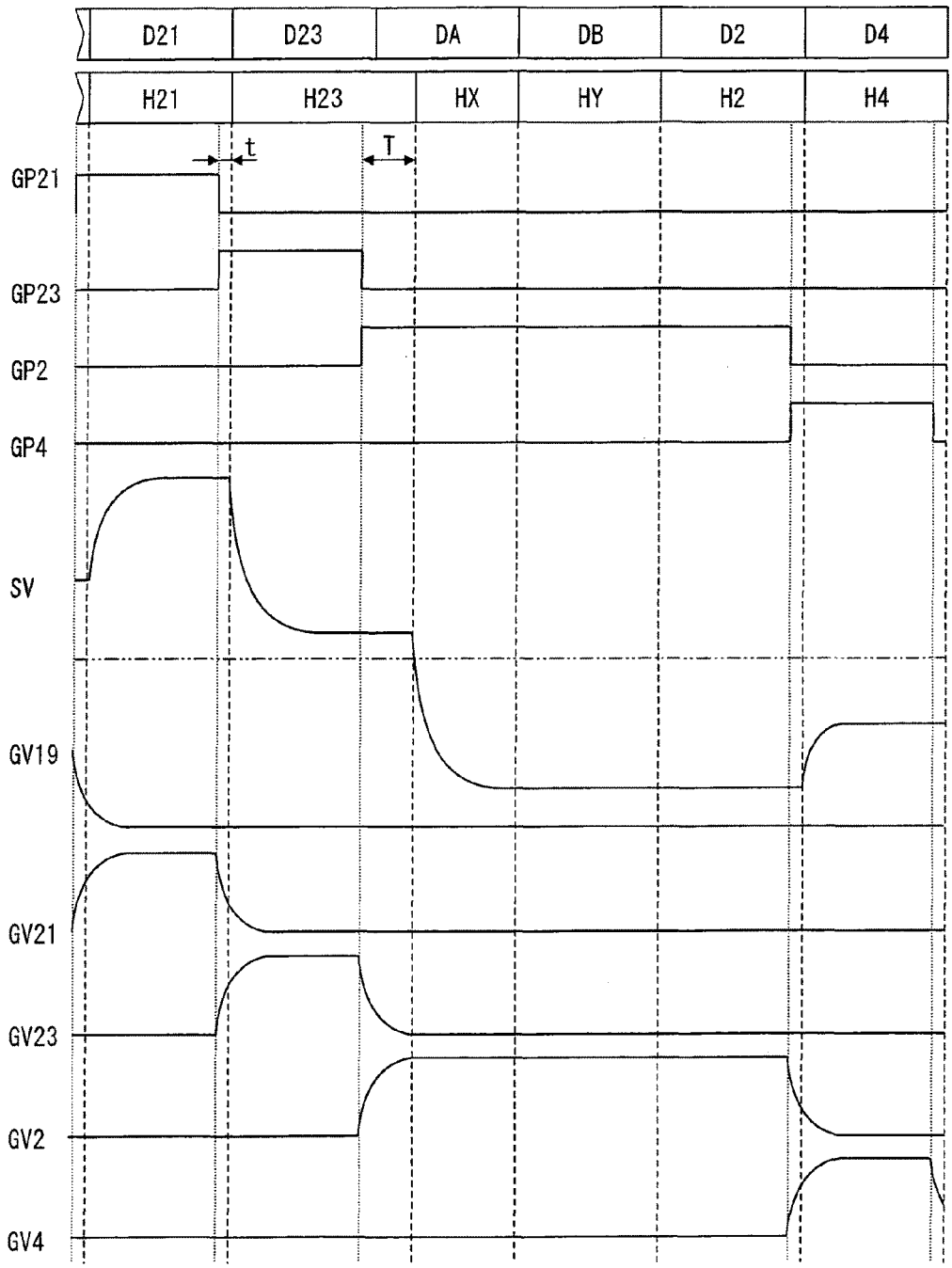
FIG. 9

As shown in FIG. 9, the horizontal scan period H21 (a time period during which a data signal electric potential which has a positive polarity and corresponds to the video data D21 is being supplied to the data signal line S) is started after the gate pulse GP21 becomes active, and then the horizontal scan period H21 is ended after a time period t is elapsed since the gate pulse GP21 becomes nonactive.

The gate pulse GP 23 becomes active in sync with the gate pulse GP21 becoming nonactive. Then, the horizontal scan period H23 (a time period during a data signal electric potential which has a positive polarity and corresponds to the video data D23 is being supplied to the data signal line S) is started. The horizontal scan period H23 is ended after a time period T (>t) is elapsed since the gate pulse GP23 becomes nonactive. The dummy scan period HX is started concurrently with the horizontal scan period H23 being ended.

Note here that, even though the gate pulse GP23 becomes nonactive, an electric potential GV23 of the scanning signal line G23 does not fall precipitously but falls while becoming dull due to parasitic resistor and parasitic capacitor. That is, the TFT of the pixel P23 connected to the scanning signal line G23 is turning on for a while (during a dull period) after the gate pulse GP23 becomes nonactive.

In view of the circumstances, the time period T from a time point when the gate pulse GP23 becomes nonactive to a time point when the dummy scan period HX (a time period during which a dummy signal electric potential which has a negative polarity and corresponds to the dummy data DA is being supplied to the data signal line S) is started is set to be longer than the time period t (i.e., the horizontal scan period H23 is extended). This allows the horizontal scan period H23 to contain the dull period (most part of the dull period) of the electric potential GV23 of the scanning signal line G23. Accordingly, it is possible to prevent a phenomenon in which positive electric charge written into the pixel P23 during the horizontal scan period H23 is discharged by the dummy scan period HX being started. This makes it possible to reduce blackish lateral stripes (see FIG. 20) which have been the problem of a conventional display.

[Embodiment 2]

A liquid crystal display device of Embodiment 2 has a display section (e.g., of a normally black mode) in which scanning signal lines (G1 through G1080) and retention capacitor lines (CS1 through CS1081) which extend in parallel with the scanning signal lines (see FIG. 11) are provided. Each of pixels has two subpixels provided in a column direction (in a direction in which data signal lines extend), and one (1) pixel electrode is provided for each of the subpixels. Moreover, one (1) retention capacitor line is provided for each gap between any adjacent two pixels in the column direction. A capacitor is defined by the one (1) retention capacitor line and a pixel electrode provided in one of the adjacent two pixels, and a capacitor is defined by the one (1) retention capacitor line and a pixel electrode provided in the other of the adjacent two pixels.

Specifically, in a case where an i-th pixel in a pixel column is referred to as a pixel Pi, the retention capacitor lines CS1 and CS1081 are provided on both sides of the pixel column, and a retention capacitor line CS(i+1) (i is an integer of 1 to 1079) is provided for a gap between the pixel Pi and a pixel P(i+1). Moreover, the pixel Pi (i is an integer of 1 to 1080) has two pixel electrodes each of which is connected to a scanning signal line Gi and a data signal line SL via a corresponding transistor. A retention capacitor is defined by one of the two pixel electrodes and a retention capacitor line CSi and a retention capacitor is defined by the other of the two pixel electrodes and the retention capacitor line CS(i+1).

For example, a retention capacitor line CS1 is provided on one side (on an upstream side) of a pixel column, a retention capacitor line CS2 is provided for a gap between a pixel P1 and a pixel P2, and a retention capacitor line CS3 is provided for a gap between the pixel P2 and a pixel P3. The pixel P1 has two pixel electrodes each of which is connected to the scanning signal line G1 and the data signal line SL via a transistor. A retention capacitor is defined by one of the two pixel electrodes and the retention capacitor line CS1, and a retention capacitor is defined by the other of the two pixel electrodes and the retention capacitor line CS2. The pixel P2 has two pixel electrodes each of which is connected to the scanning signal line G2 and the data signal line SL via a transistor. A retention capacitor is defined by one of the two pixel electrodes and the retention capacitor line CS2, and a retention capacitor is defined by the other of the two pixel electrodes and the retention capacitor line CS3.

According to the liquid crystal display device of Embodiment 2, (i) driving of the data signal line S and the scanning signal lines G1 through G1080 and (ii) setting of the horizontal scan periods and the dummy scan periods are identical to those shown in FIGS. 8 and 9.

Figure 12:
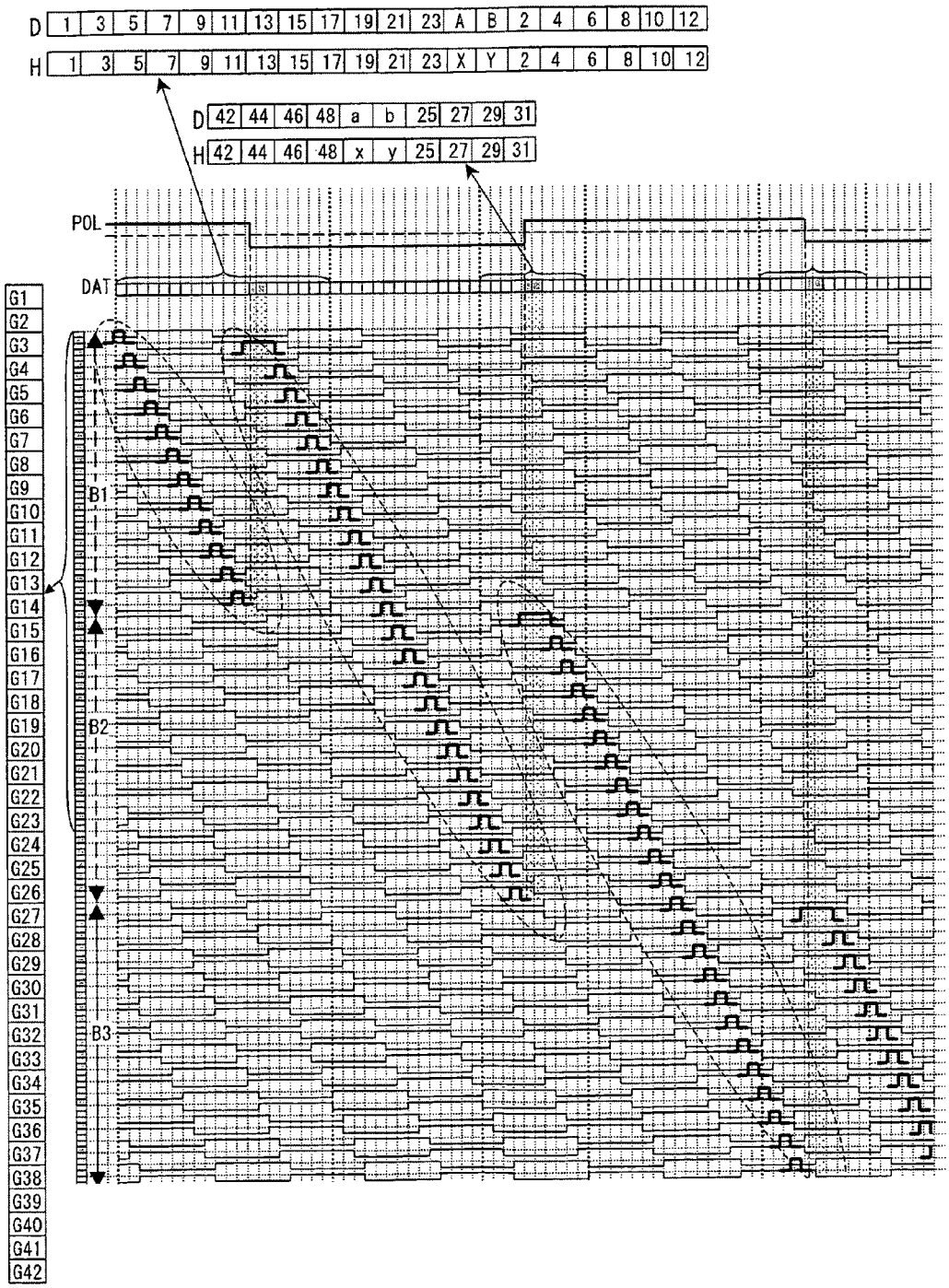
FIG. 12
Figure 13:
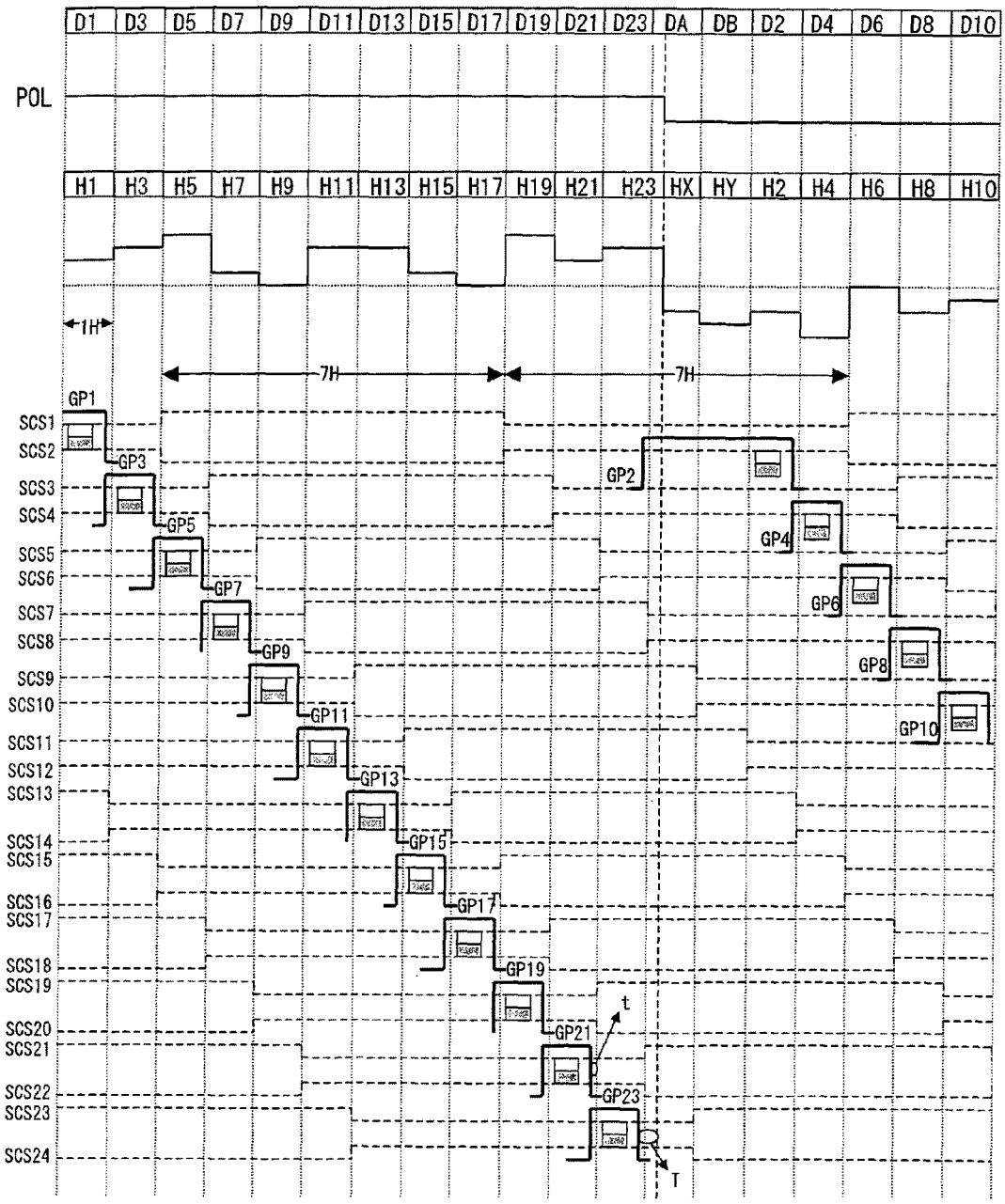
FIG. 13
Figure 14:
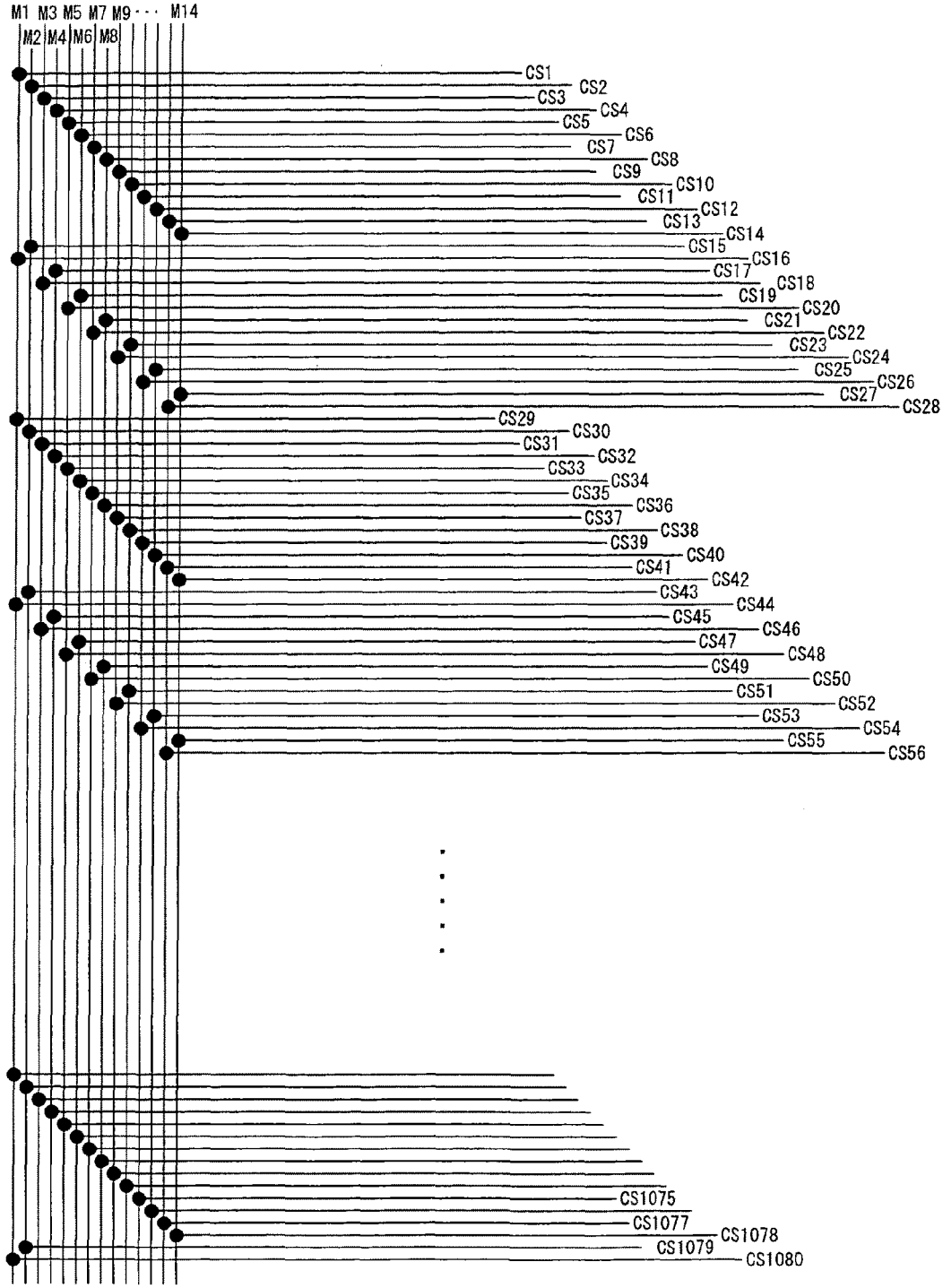
FIG. 14

The following describes a retention capacitor line signal SCSi which is to be supplied to the retention capacitor line CSi (i is an integer of 1 to 1080) from a CS driver circuit (CS driver), with reference to FIGS. 12 through 14. Each of retention capacitor line signals SCS1 through SCS1081 has a waveform which has any one of 14 phases (the first phase as represented by the retention capacitor line signal SCSI, the second phase as represented by SCS2, the third phase as represented by SCS3, the fourth phase as represented by SCS4, the fifth phase as represented by SCS5, the sixth phase as represented by SCS6, the seventh phase represented by SCS7, the eighth phase as represented by SCS8, the ninth phase as represented by SCS9, the tenth phase as represented by SCS10, the eleventh phase as represented by SCS11, the twelfth phase as represented by SCS12, the thirteenth phase as represented by SCS13, and the fourteenth phase as represented by SCS14) (see FIGS. 12 and 13).

The phases have identical cycles (each of which has a cycle of 14H including (i) a first stage in which a high level continues for 7H and (ii) a second stage in which a low level continues for 7H). The second phase as represented by SCS2 has a phase-delay of half cycle (7H) with respect to the first phase as represented by SCS1. With regard to an arbitrary odd-numbered phase and a subsequent odd-numbered phase, the subsequent odd-numbered phase has a phase-delay of 1H with respect to the arbitrary odd-numbered phase. With regard to an arbitrary even-numbered phase and a subsequent even-numbered phase, the subsequent even-numbered phase has a phase-delay of 1H with respect to the arbitrary even-numbered phase. For example, the third phase as represented by the retention capacitor line signal SCS3 has a phase-delay of 1H with respect to the first phase as represented by SCS1, and the fourth phase as represented by SCS4 has a phase-delay of 1H with respect to the second phase as represented by SCS2.

Retention capacitor line signals SCS(28*j*+1) and SCS(28*k*+16) have a waveform which has the first phase, where j is an integer of 0 to 38, and k is an integer of 0 to 38. Retention capacitor line signals SCS(28*j*+2) and SCS(28*k*+15) have a waveform which has the second phase, where j is an integer of 0 to 38, and k is an integer of 0 to 38. Retention capacitor line signals SCS(28*j*+3) and SCS(28*k*+18) have a waveform which has the third phase, where j is an integer of 0 to 38, and k is an integer of 0 to 37 (same applies to the followings). Retention capacitor line signals SCS(28*j*+4) and SCS(28*k*+17) have a waveform which has the fourth phase. Retention capacitor line signals SCS(28*j*+5) and SCS(28*k*+20) have a waveform which has the fifth phase. Retention capacitor line signals SCS(28*j*+6) and SCS(28*k*+19) have a waveform which has the sixth phase. Retention capacitor line signals SCS(28*j*+7) and SCS(28*k*+22) have a waveform which has the seventh phase. Retention capacitor line signals SCS(28*j*+8) and SCS(28*k*+21) have a waveform which has the eighth phase. Retention capacitor line signals SCS(28*j*+9) and SCS(28*k*+24) have a waveform which has the ninth phase. Retention capacitor line signals SCS(28*j*+10) and SCS(28*k*+23) have a waveform which has the tenth phase. Retention capacitor line signals SCS(28*j*+11) and SCS(28*k*+26) have a waveform which has the eleventh phase. Retention capacitor line signals SCS(28*j*+12) and SCS(28*k*+25) have a waveform which has the twelfth phase. Retention capacitor line signals SCS(28*j*+13) and SCS(28*k*+28) have a waveform which has the thirteenth phase. Retention capacitor line signals SCS(28*j*+114) and SCS(28*k*+27) have a waveform which has the fourteenth phase.

Note that the retention capacitor line signals which have first through fourteenth phases are supplied to retention capacitor trunk lines M1 through M14, respectively (see FIG. 14). The retention capacitor lines CS(28*j*+1) and CS(28*k*+16) are connected to the retention capacitor trunk line M1, where j is an integer of 0 to 38, and k is an integer of 0 to 38. The retention capacitor lines CS(28*j*+2) and CS(28*k*+15) are connected to the retention capacitor trunk line M2, where j is an integer of 0 to 38, and k is an integer of 0 to 38. The retention capacitor lines CS(28*j*+3) and CS(28*k*+18) are connected to the retention capacitor trunk line M3, where j is an integer of 0 to 38, and k is an integer of 0 to 37 (same applies to the followings). The retention capacitor lines CS(28*j*+4) and CS(28*k*+17) are connected to the retention capacitor trunk line M4. The retention capacitor lines CS(28*j*+5) and CS(28*k*+20) are connected to the retention capacitor trunk line M5. The retention capacitor lines CS(28*j*+6) and CS(28*k*+19) are connected to the retention capacitor trunk line M6. The retention capacitor lines CS(28*j*+7) and CS(28*k*+22) are connected to the retention capacitor trunk line M7. The retention capacitor lines CS(28*j*+8) and CS(28*k*+21) are connected to the retention capacitor trunk line M8. The retention capacitor lines CS(28*j*+9) and CS(28*k*+24) are connected to the retention capacitor trunk line M9. The retention capacitor lines CS(28*j*+10) and CS(28*k*+23) are connected to the retention capacitor trunk line M10. The retention capacitor lines CS(28*j*+11) and CS(28*k*+26) are connected to the retention capacitor trunk line M11. The retention capacitor lines CS(28*j*+12) and CS(28*k*+25) are connected to the retention capacitor trunk line M12. The retention capacitor lines CS(28*j*+13) and CS(28*k*+28) are connected to the retention capacitor trunk line M13. The retention capacitor lines CS(28*j*+14) and CS(28*k*+27) are connected to the retention capacitor trunk line M14.

The retention capacitor line signals SCS1 through SCS1081 have respective waveforms as described above. Moreover, according to the liquid crystal display device of the present embodiment, (i) the retention capacitor line signal SCS1 (first phase) is being at an "L" level during the horizontal scan period H1 which corresponds to the scanning signal line G1, and the "L" level is shifted to an "H" level at a timing when 1H is elapsed after the horizontal scan period H1 is ended and (ii) the retention capacitor line signal SCS2 (second phase) is being at an "H" level during the horizontal scan period H1 which corresponds to the scanning signal line G1, and the "H" level is shifted to an "L" level at a timing when 1H is elapsed after the horizontal scan period H1 is ended (see FIG. 13).

One of two subpixels of the pixel P1 includes a first pixel electrode, which causes a retention capacitor to be defined by the pixel electrode and the retention capacitor line CS1, and the other of the two subpixels includes a second pixel electrode, which causes a retention capacitor to be defined by the pixel electrode and the retention capacitor line CS2. Signal electric potentials having a positive polarity are supplied to the two pixel electrodes in the horizontal scan period H1. The electric potential of the first pixel electrode is increased in response to the retention capacitor line signal SCS1 being shifted from the level "L" to level "H". The electric potential of the second pixel electrode is decreased in response to the retention capacitor line signal SCS2 being shifted from the level "H" to level "L". This causes (i) the subpixel, which includes the first pixel electrode, to be a "bright subpixel" and (ii) the subpixel, which includes the second pixel electrode, to be a "dark subpixel" (see FIG. 15). The bright and dark subpixels make it possible to display a halftone.

According to the retention capacitor line signals SCS1 and SCS2 (first and second phases), (i) the retention capacitor line signal SCS2 (second phase) is being at a level "H" during the horizontal scan period H2 which corresponds to the scanning signal line G2, and the level "H" is shifted to a level "L" at a timing when 1H is elapsed after the horizontal scan period H2 is ended and (ii) the retention capacitor line signal SCS3 (third phase) is being at a level "L" during the horizontal scan period H2 which corresponds to a scanning signal line G2, and the level "L" is shifted to a level "H" at a timing when 2H is elapsed after the horizontal scan period H2 is ended.

One of two subpixels of the pixel P2 includes a third pixel electrode, which causes a retention capacitor to be defined by the pixel electrode and the retention capacitor line CS2, and the other of the two subpixels includes a fourth pixel electrode which causes a retention capacitor to be defined by the pixel electrode and the retention capacitor line CS3. Signal electric potentials having a negative polarity are supplied to the two pixel electrodes in the horizontal scan period H2. The electric potential of the third pixel electrode is decreased in response to the retention capacitor line signal SCS2 being shifted from the level "H" to level "L". The electric potential of the fourth pixel electrode is increased in response to the retention capacitor line signal SCS3 being shifted from the level "L" to level "H". This causes (i) the subpixel, which includes the third pixel electrode to be a "bright subpixel" and (ii) the subpixel, which includes the fourth pixel electrode to be a "dark subpixel" (see FIG. 15). The bright and dark subpixels make it possible to display a halftone.

According to the retention capacitor line signals SCS1 and SCS2 (first and second phases), (i) the retention capacitor line signal SCS3 (third phase) is being at the level "L" during the horizontal scan period H3 which corresponds to the scanning signal line G3, and the level "L" is shifted to the level "H" at a timing when 1H is elapsed after the horizontal scan period H3 is ended and (ii) the retention capacitor line signal SCS4 (fourth phase) is being at a level "H" during the horizontal scan period H3 which corresponds to the scanning signal line G3, and the level "H" is shifted to a level "L" at a timing when 1H is elapsed after the horizontal scan period H3 is ended.

One of two subpixels of the pixel P1 includes a fifth pixel electrode which causes a retention capacitor to be defined by the pixel electrode and the retention capacitor line CS3, and the other of the two subpixels includes a sixth pixel electrode which causes a retention capacitor to be defined by the pixel electrode and the retention capacitor line CS4. Signal electric potentials having a positive polarity are supplied to the two pixel electrodes in the horizontal scan period H3. The electric potential of the fifth pixel electrode is increased in response to the retention capacitor line signal SCS3 being shifted from the level "L" to level "H". The electric potential of the sixth pixel electrode is decreased in response to the retention capacitor line signal SCS4 being shifted from the level "H" to level "L". This causes (i) the subpixel, which includes the fifth pixel electrode, to be a "bright subpixel" and (ii) the subpixel, which includes the sixth pixel electrode, to be a "dark subpixel" (see FIG. 15). The bright and dark subpixels make it possible to display a halftone.

Figure 15:
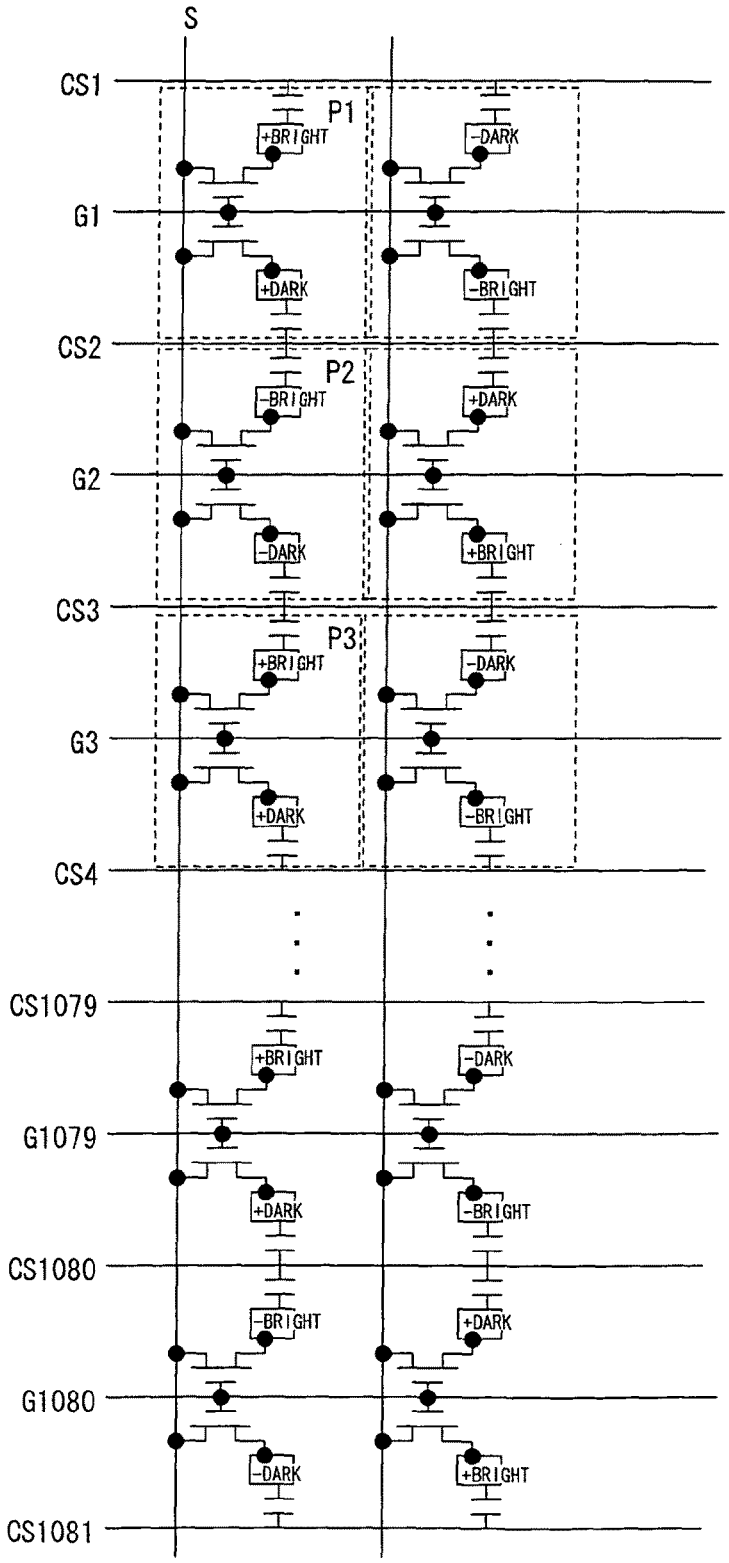
FIG. 15

According to the liquid crystal display device of the present embodiment, two subpixels in one (1) pixel serve as respective of a "bright subpixel" and a "dark subpixel" so as to display a halftone (see FIG. 15). This makes it possible to enhance a viewing angle characteristic. Further, one (1) pixel column is alternated between the bright subpixel and the dark subpixel (in a checkered manner). This makes it possible to achieve a smooth display with little roughness.

Figure 16:
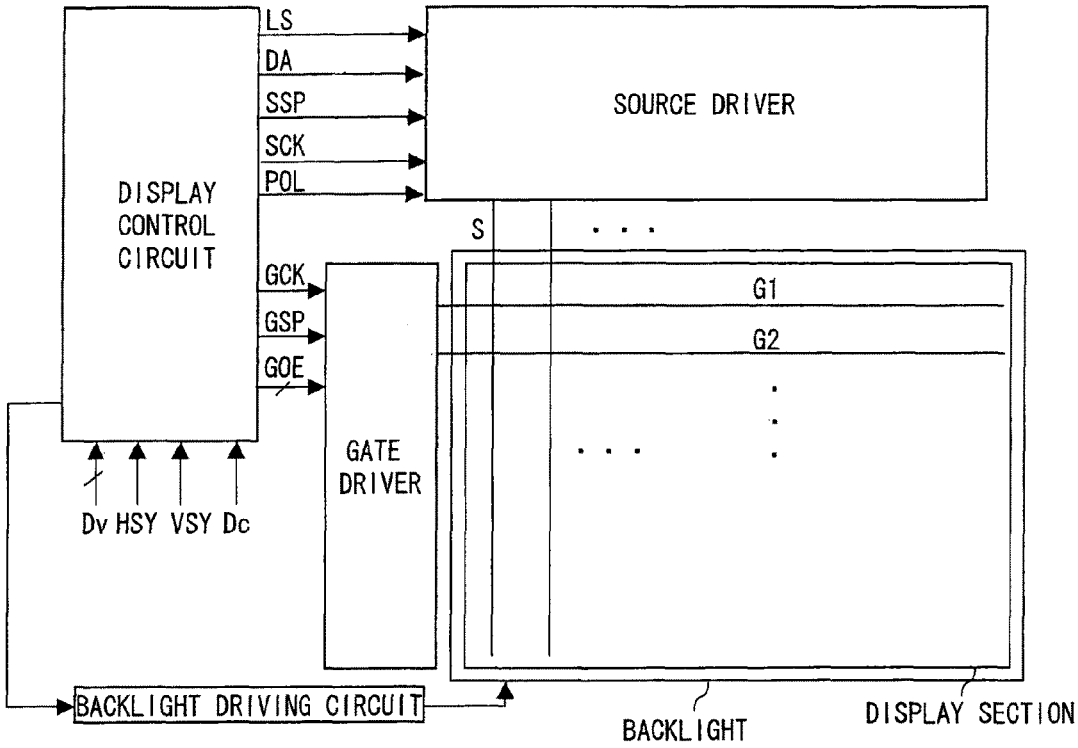
FIG. 16
Figure 17:
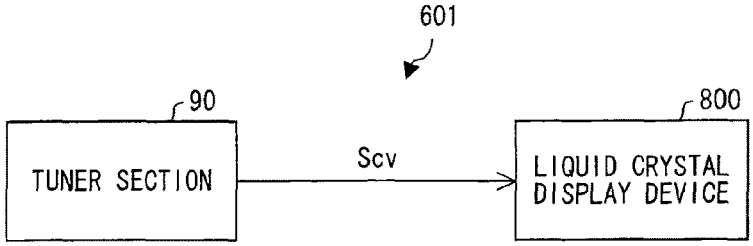
FIG. 17
Figure 18:
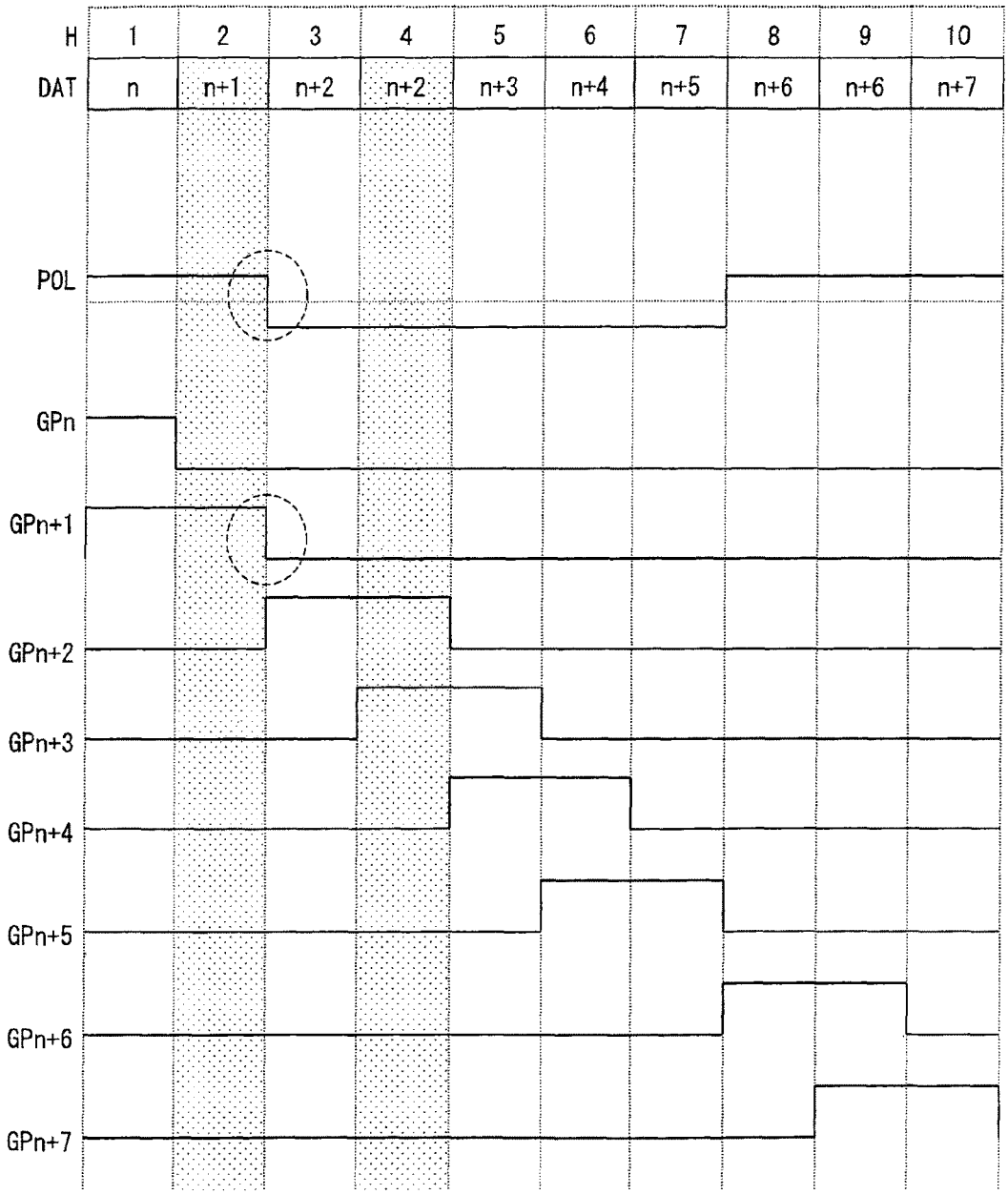
FIG. 18
Figure 19:
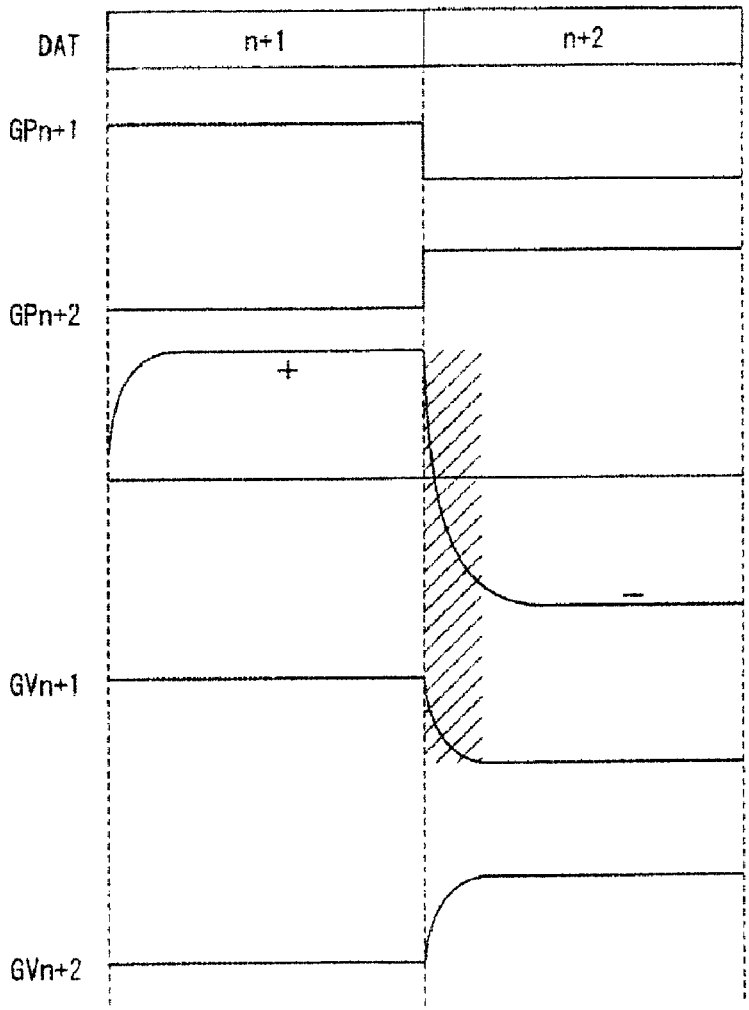
FIG. 19

FIG. 16 is a block diagram illustrating an example configuration of the liquid crystal display device of Embodiment 1. As shown in FIG. 16, the liquid crystal display device includes a display section (liquid crystal panel), a source driver, a gate driver, a backlight, a backlight driving circuit, and a display control circuit. The source driver drives the data signal line. The gate driver drives the scanning signal lines. The display control circuit controls the source driver, the gate driver, and the backlight driving circuit.

The display control circuit receives, from an external signal source (e.g., a tuner), (i) a digital video signal Dv which is indicative of an image to be displayed, (ii) a horizontal sync signal HSY and a vertical sync signal VSY which correspond to the digital video signal Dv, and (iii) a control signal Dc for controlling display behavior. Based on the received signals Dv, HSY, VSY, and Dc, the display control circuit generates and outputs, as signals for causing the display section to display the image indicated by the digital video signal Dv, (i) a data start pulse signal SSP, (ii) a data clock signal SCK, (iii) a digital image signal DA (corresponding to the video signal Dv) indicative of the image to be displayed, (iv) a gate start pulse signal GSP, (v) a gate clock signal GCK, (vi) a gate driver output control signal (scanning signal output control signal) GOE, (vii) a polarity-reversal signal POL for controlling a polarity of a signal electric potential to be supplied to the data signal line, and (viii) a latch strobe signal LS for defining a horizontal scan period and a dummy scan period.

More specifically, the video signal Dv, which has been subjected to timing adjustment, etc. as appropriate in an internal memory, is supplied from the display control circuit as the digital image signal DA. The data clock signal SCK is generated as a signal having pulses corresponding to respective pixels of the image indicated by the digital image signal DA. The data start pulse signal SSP is generated as a signal which becomes a high level (H level) for a predetermined period for each horizontal scan period in response to the horizontal sync signal HSY. The gate start pulse signal GSP is generated as a signal which becomes an H level for a predetermined period for each frame period (one vertical scan period) in response to the vertical sync signal VSY. The gate clock signal GCK is generated based on the horizontal sync signal HSY. The gate driver output control signal GOE is generated based on the horizontal sync signal HSY and the control signal Dc.

Out of the signals generated in the display control circuit, the digital image signal DA, the polarity-reversal signal POL, the data start pulse signal SSP, and the data clock signal SCK are supplied to the source driver, whereas the gate start pulse signal GSP, the gate clock signal GCK, and the gate driver output control signal GOE are supplied to the gate driver.

The source driver sequentially generates, for each horizontal scan period, a data signal based on the digital image signal DA, the data clock signal SCK, the data start pulse signal SSP, the latch strobe signal LS, and the polarity-reversal signal POL. The data signal is generated as an analog electric potential which corresponds to a pixel value, for a corresponding scanning signal line, of the image indicated by the digital image signal DA. The data signals thus generated are sequentially supplied to the data signal line S for each horizontal scan period.

The gate driver generates scan signals, based on the gate start pulse signal GSP, the gate clock signal GCK, and the gate driver output control signal GOE. The scan signals thus generated are supplied to the respective scanning signal lines so that the scanning signal lines are selectively driven.

The data signal line and the scanning signal lines of the display section (liquid crystal panel) are driven by the source driver and the gate driver as described above. Accordingly, a signal electric potential, via the data signal line, is written into a pixel electrode via a TFT connected to a selected scanning signal line. This allows the liquid crystal layer of a pixel to receive a voltage in response to the digital image signal DA, and a transmission amount of the light emitted from the backlight is controlled in response to the voltage thus received so that the image indicated by the digital video signal Dv is displayed by the pixel.

In a case where an image is displayed on a liquid crystal display device 800 based on television broadcasting, the liquid crystal display device 800 is connected to a tuner section 90. This causes realization of a television receiver 601 of the present embodiment (see FIG. 17). The tuner section 90 extracts a signal of a channel to be received among waves (high-frequency signals) received via an antenna (not illustrated), and then converts the signal thus extracted into an intermediate frequency signal so as to extract a composite color video signal Scv (a television signal) by detecting the intermediate frequency signal. The composite color video signal Scv is supplied to the liquid crystal display device 800 as described above so that the liquid crystal display device 800 displays an image based on the composite color video signal Scv.

Note that, in the present invention, "a polarity of an electric potential" indicates whether the electric potential is larger or smaller than a reference electric potential. Specifically, an "electric potential having a positive polarity" indicates an electric potential larger than the reference electric potential, and an "electric potential having a negative polarity" indicates an electric potential smaller than the reference electric potential. Note also that the reference electric potential can be an electric potential Vcom (common electric potential) of a common electrode (counter electrode). Alternatively, the reference electric potential can be another arbitrary electric potential.

Note that the present invention is not limited to the embodiments, but can be altered by a skilled person in the art within the scope of the claims. An embodiment derived from a proper combination of technical means disclosed in respective different embodiments is also encompassed in the technical scope of the present invention.

INDUSTRIAL APPLICABILITY

The liquid crystal display device of the present invention is suitable for, for example, a liquid crystal television.

REFERENCE SIGNS LIST

G1 through G1080: Scanning signal line
B1 through B3: Block
P1 through P1080: Pixel
D: Video data
H: Horizontal scan period
HX, Hx: First dummy scan period
HY, Hy: Second dummy scan period
S: Data signal line
CS1 through 1081: Retention capacitor line
601: Television receiver
800: Liquid crystal display device

The invention claimed is:

1. A liquid crystal display device, wherein:

a plurality of groups each of which includes a plurality of scanning signal lines are sequentially selected;

data signal electric potentials having identical polarities are sequentially supplied to a data signal line for each horizontal scan period, in response to a plurality of scanning signal lines, which belong to a selected one of the plurality of groups, being sequentially subjected to horizontal scans;

a scanning pulse for each of the horizontal scans is supplied to each of the plurality of scanning signal lines;

a polarity of the data signal electric potentials for a first group is different from that of a second group, the first and second groups being sequentially selected, the second group being selected after the first group is selected;

n-piece (n is an integer of 1 or more) of dummy scan period(s) is(are) put between (i) a horizontal scan period corresponding to a last horizontal scan in the first group and (ii) a horizontal scan period corresponding to a first horizontal scan in the second group;

a dummy signal electric potential is supplied to the data signal line in a dummy scan period included in the n-piece of dummy scan period(s); and a time period from a time point when a scanning pulse which corresponds to the last horizontal scan in the first group becomes nonactive to a time point when the dummy scan period is started is set to be longer than a time period from a time point when a scanning pulse corresponding to one of consecutive two horizontal scans becomes nonactive in the first group to a time point when a horizontal scan period corresponding to the other of the consecutive two horizontal scans is started.

2. The liquid crystal display device as set forth in claim 1, wherein:

the dummy signal electric potential has a polarity which is identical to a polarity of the data signal electric potentials in the second group.

3. The liquid crystal display device as set forth in claim 1, wherein:

the scanning pulse corresponding to the other of the consecutive two horizontal scans becomes active in sync with the scanning pulse corresponding to the one of the consecutive two horizontal scans becoming nonactive.

4. The liquid crystal display device as set forth in claim 1, wherein:

a horizontal scan period corresponding to an arbitrary horizontal scan is started after a scanning pulse corresponding to the arbitrary horizontal scan becomes active.

5. The liquid crystal display device as set forth in claim 1, wherein:

the horizontal scan period corresponding to the last horizontal scan in the first group is longer than a previous horizontal scan period which comes before the horizontal scan period corresponding to the last horizontal scan in the first group.

6. The liquid crystal display device as set forth in claim 1, wherein:

a scanning pulse corresponding to the first horizontal scan in the second group becomes active before the dummy scan period is started.

7. The liquid crystal display device as set forth in claim 1, wherein:

a scanning pulse corresponding to the first horizontal scan in the second group becomes active after the dummy scan period is started.

8. The liquid crystal display device as set forth in claim 1, wherein:

the horizontal scan period corresponding to the other of the consecutive two horizontal scans is started in sync with the scanning pulse corresponding to the one of the consecutive two horizontal scans becoming nonactive.

9. The liquid crystal display device as set forth in claim 1, wherein:

plural pieces of video data which correspond to respective horizontal scans on the plurality of scanning signal lines are arranged in an order corresponding to the horizontal scans;

n-piece of dummy data is(are) put between (i) a piece of video data corresponding to the last horizontal scan in the first group and (ii) a piece of video data corresponding to the first horizontal scan in the second group;

the data signal electric potentials correspond to the respective plural pieces of video data; and the dummy signal electric potential corresponds to a piece of dummy data included in the n-piece of dummy data.

10. The liquid crystal display device as set forth in claim 9, wherein:

the plural pieces of video data and the piece of dummy data are latched in sync with latch pulses;

an interval, between (i) a latch pulse, in sync with which the piece of video data corresponding to the last horizontal scan in the first group is latched and (ii) a latch pulse, in sync with which the piece of dummy data is latched, is wider than an interval between (i) a latch pulse, in sync with which a piece of video data corresponding to a second last horizontal scan in the first group is latched and (ii) the latch pulse, in sync with the piece of video data corresponding to the last horizontal scan in the first group is latched.

11. The liquid crystal display device as set forth in claim 1, wherein:

in a case where a certain scanning signal line is defined as a first scanning signal line in numerical order, one of the first and second groups includes only odd-numbered scanning signal lines, and the other of the first and second groups includes only even-numbered scanning signal lines.

12. The liquid crystal display device as set forth in claim 1, wherein:

in a case where (i) a certain scanning line and its subsequent scanning signal lines are divided into a plurality of blocks and (ii) a block to which the certain scanning line belongs and which is one end block of the plurality of blocks is referred to as a most upstream block and a block which is the other end block is referred to as a most downstream block, scanning signal lines which belong to each of the plurality of blocks are divided into groups, and the plurality of blocks are sequentially selected from groups of the most upstream block to groups of the most downstream block.

13. The liquid crystal display device as set forth in claim 1, wherein:

each of a plurality of pixels is made up of a plurality of subpixels.

14. The liquid crystal display device as set forth in claim 13, wherein:

the plurality of subpixels include respective pixel electrodes;

retention capacitor lines are provided for the respective pixel electrodes; and a luminance of each of the plurality of subpixels is controlled in response to a retention capacitor line signal supplied to a corresponding one of the retention capacitor lines.

15. A television receiver comprising:

a liquid crystal display device recited in claim 1; and a tuner section which receives television broadcasting.

16. A liquid crystal display device, wherein:

a plurality of groups each of which includes a plurality of scanning signal lines are sequentially selected;

data signal electric potentials which have identical polarities and correspond to respective plural pieces of video data are sequentially supplied to a data signal line, in response to a plurality of scanning signal lines, which belong to a selected one of the plurality of groups, being sequentially subjected to horizontal scans;

a scanning pulse for each of the horizontal scans is supplied to each of the plurality of scanning signal lines;

a polarity of the data signal electric potentials for a first group is different from that of a second group, the first and second groups being sequentially selected, the second group being selected after the first group is selected;

n-piece (n is an integer of 1 or more) of dummy data is(are) put between (i) a piece of video data corresponding to a last horizontal scan in the first group and (ii) a piece of video data corresponding to a first horizontal scan in the second group;

a dummy signal electric potential which corresponds to a piece of dummy data included in the n-piece of dummy data is supplied to the data signal line; and a time period from outputting of a piece of video data corresponding to the last horizontal scan in the first group, after a scanning pulse which corresponds to the last horizontal scan becomes nonactive, to switching to outputting of the piece of dummy data is set to be longer than a time period from outputting of a piece of video data corresponding to one of consecutive two horizontal scans in the first group, after a scanning pulse which corresponds to the one of consecutive two horizontal scans becomes nonactive, to switching to outputting of a piece of video data corresponding to the other of the consecutive two horizontal scans.

17. The liquid crystal display device as set forth in claim 16, wherein:

the dummy signal electric potential has a polarity which is identical to a polarity of the data signal electric potentials in the second group.

18. The liquid crystal display device as set forth in claim 16, wherein:

the scanning pulse corresponding to the other of the consecutive two horizontal scans becomes active in sync with the scanning pulse corresponding to the one of the consecutive two horizontal scans becoming nonactive.

19. The liquid crystal display device as set forth in claim 16, wherein:

outputting of a piece of video data corresponding to an arbitrary horizontal scan is started after a scanning pulse corresponding to the arbitrary horizontal scan becomes active.

20. The liquid crystal display device as set forth in claim 16, wherein:

a scanning pulse corresponding to the first horizontal scan in the second group becomes active before outputting of the dummy signal electric potential is started.

21. The liquid crystal display device as set forth in claim 16, wherein:

a scanning pulse corresponding to the first horizontal scan in the second group becomes active after outputting of the dummy signal electric potential is started.

22. The liquid crystal display device as set forth in claim 16, wherein:

the plural pieces of video data and the piece of dummy data are outputted in sync with latch pulses, in sync with which the plural pieces of video data and the piece of dummy data are latched;

an interval, between (i) a latch pulse, in sync with which the piece of video data corresponding to the last horizontal scan in the first group is latched and (ii) a latch pulse, in sync with which the piece of dummy data is latched is wider than an interval between (i) a latch pulse, in sync with which a piece of video data corresponding to a second last horizontal scan in the first group is latched and (ii) the latch pulse, in sync with the piece of video data corresponding to the last horizontal scan in the first group is latched.

23. A liquid crystal display device, wherein:

at least one dummy scan period is inserted every consecutive horizontal scan periods;

a polarity of signal electric potentials supplied to a data signal line is reversed in the at least one dummy scan period following a horizontal scan period; and a horizontal scan period which is previous to the at least one dummy scan period is set to be longer than a horizontal scan period which is not previous to the at least one dummy scan period.

24. The liquid crystal display device as set forth in claim 23, wherein:

a scanning pulse is outputted in each of the horizontal scan periods; and a scanning pulse corresponding to the horizontal scan period which is previous to the at least one dummy scan period has a width which is identical to that of a scanning pulse corresponding to the horizontal scan period which is not previous to the at least one dummy scan period.

25. The liquid crystal display device as set forth in claim 23, wherein:

the at least one dummy scan period which is subsequent to a horizontal scan period is set to be shorter than the horizontal scan period which is not previous to the at least one dummy scan period.

26. A method for driving a liquid crystal display device, in which device a plurality of groups each of which includes a plurality of scanning signal lines are sequentially selected, data signal electric potentials having identical polarities are sequentially supplied to a data signal line for each horizontal scan period, in response to a plurality of scanning signal lines, which belong to a selected one of the plurality of groups, being sequentially subjected to horizontal scans, said method comprising the steps of:

supplying a scanning pulse for each of the horizontal scans to each of the plurality of scanning signal lines;

causing a polarity of the data signal electric potentials for a first group to be different from that of a second group, the first and second groups being sequentially selected, the second group being selected after the first group is selected;

putting n-piece (n is an integer of 1 or more) of dummy scan period(s) between (i) a horizontal scan period corresponding to a last horizontal scan in the first group and (ii) a horizontal scan period corresponding to a first horizontal scan in the second group;

supplying a dummy signal electric potential to the data signal line in a dummy scan period included in the n-piece of dummy scan period(s); and causing a time period from a time point when a scanning pulse which corresponds to the last horizontal scan in the first group becomes nonactive to a time point when the dummy scan period is started to be set to be longer than a time period from a time point when a scanning pulse corresponding to one of consecutive two horizontal scans becomes nonactive in the first group to a time point when a horizontal scan period corresponding to the other of the consecutive two horizontal scans is started.

* * * * *